US010656543B2

(12) United States Patent
Shimizu et al.

(10) Patent No.: US 10,656,543 B2
(45) Date of Patent: May 19, 2020

(54) ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Tomofumi Shimizu, Osaka (JP); Hideki Okada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/302,716

(22) PCT Filed: Apr. 27, 2017

(86) PCT No.: PCT/JP2017/016748
§ 371 (c)(1),
(2) Date: Nov. 19, 2018

(87) PCT Pub. No.: WO2017/203931
PCT Pub. Date: Nov. 30, 2017

(65) Prior Publication Data

US 2019/0317414 A1 Oct. 17, 2019

(30) Foreign Application Priority Data

May 25, 2016 (JP) ..... 2016-104311

(51) Int. Cl.
*G03G 5/06* (2006.01)
*G03G 5/05* (2006.01)

(52) U.S. Cl.
CPC ..... *G03G 5/0603* (2013.01); *G03G 5/056* (2013.01); *G03G 5/0609* (2013.01); *G03G 5/0614* (2013.01)

(58) Field of Classification Search
CPC ..... G03G 5/0609; G03G 5/0603
See application file for complete search history.

(56) References Cited

U.S. PATENT DOCUMENTS 7,838,191 B2 * 11/2010 Kuboshima ..... G03G 5/056 399/159
RE42,189 E * 3/2011 Imanaka ..... G03G 5/04 430/100

(Continued)

FOREIGN PATENT DOCUMENTS

JP 2008-156302 A 7/2008

*Primary Examiner* — Christopher D Rodee
(74) *Attorney, Agent, or Firm* — Studebaker & Brackett PC

(57) ABSTRACT

An electrophotographic photosensitive member (1) includes a conductive substrate (2) and a photosensitive layer (3). The photosensitive layer (3) is a single-layer photosensitive layer (3*c*) containing a charge generating material and an electron transport material. The electron transport material includes a compound represented by general formula (1) shown below. An amount of charge of calcium carbonate as measured by charging the calcium carbonate through friction with the photosensitive layer (3) is at least +7.0 μC/g. In general formula (1), $R^1$ and $R^2$ each represent, independently of each other, a halogen atom, for example. Further, m, n, and Y are as described in the description.

(Continued)

(1)

15 Claims, 4 Drawing Sheets

(56) References Cited

U.S. PATENT DOCUMENTS

| | | | | |
|---|---|---|---|---|
| 8,192,905 | B2 * | 6/2012 | Shimoyama | G03G 5/051 399/159 |
| 2016/0223923 | A1 * | 8/2016 | Iwashita | G03G 5/0609 |
| 2018/0299797 | A1 * | 10/2018 | Shimizu | G03G 5/0618 |

* cited by examiner

ELECTROPHOTOGRAPHIC PHOTOSENSITIVE MEMBER, PROCESS CARTRIDGE, AND IMAGE FORMING APPARATUS

TECHNICAL FIELD

The present invention relates to an electrophotographic photosensitive member, a process cartridge, and an image forming apparatus.

BACKGROUND ART

An electrophotographic photosensitive member (hereinafter may be referred to as a photosensitive member) is used in an electrophotographic image forming apparatus. A multi-layer photosensitive member or a single-layer photosensitive member is for example used as the photosensitive member. The multi-layer photosensitive member includes a photosensitive layer that includes a charge generating layer and a charge transport layer. The charge generating layer has a charge generation function and the charge transport layer has a charge transport function. The single-layer photosensitive member includes a photosensitive layer that is a single-layer photosensitive layer having the charge generation function and the charge transport function.

A photosensitive member disclosed in Patent Literature 1 includes a photosensitive layer. The photosensitive layer contains for example a compound represented by chemical formula (E-1).

(E-1)

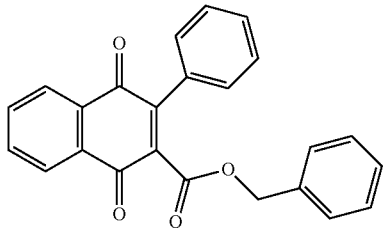

CITATION LIST

Patent Literature

[Patent Literature 1]
Japanese Patent Application Laid-Open Publication No. 2008-156302

SUMMARY OF INVENTION

Technical Problem

However, there is still room for improvement on the photosensitive member disclosed in Patent Literature 1 that includes the photosensitive layer containing the compound represented by chemical formula (E-1) in terms of inhibition of generation of white spots in an image being formed.

The present invention was made in view of the foregoing and has its object of providing an electrophotographic photosensitive member that can inhibit generation of white spots in an image being formed. Also, the present invention has its object of providing a process cartridge and an image forming apparatus each including such an electrophotographic photosensitive member and by which generation of white spots in an image being formed can be inhibited.

Solution to Problem

An electrophotographic photosensitive member of the present invention includes a conductive substrate and a photosensitive layer. The photosensitive layer is a photosensitive layer of a single-layer structure containing a charge generating material and an electron transport material. The electron transport material includes a compound represented by general formula (1) shown below. An amount of charge of calcium carbonate as measured by charging the calcium carbonate through friction with the photosensitive layer is at least +7.0 μC/g.

(1)

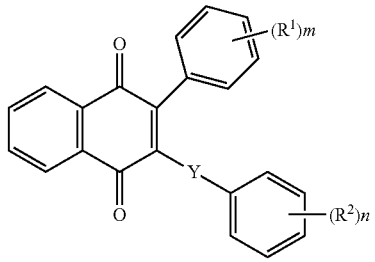

In general formula (1), $R^1$ and $R^2$ each represent, independently of each other: a halogen atom; an alkyl group having a carbon number of at least 1 and no greater than 8 and having at least one halogen atom; an aryl group having a carbon number of at least 6 and no greater than 14, having at least one halogen atom, and optionally having an alkyl group having a carbon number of at least 1 and no greater than 6; an aralkyl group having a carbon number of at least 7 and no greater than 20 and having at least one halogen atom; or a cycloalkyl group having a carbon number of at least 3 and no greater than 10 and having at least one halogen atom. Further, m and n each represent, independently of each other, an integer of at least 0 and no greater than 5, with the proviso that at least one of the integers represented by m and n is not 0. Y represents —CO—O—$CH_2$—, —CO—, or —CO—O—.

A process cartridge of the present invention includes the above-described electrophotographic photosensitive member.

An image forming apparatus of the present invention includes the above-described electrophotographic photosensitive member, a charger, a light exposure device, a developing device, and a transfer device. The charger charges a surface of the electrophotographic photosensitive member. The light exposure device irradiates the charged surface of the electrophotographic photosensitive member with light to form an electrostatic latent image on the surface of the electrophotographic photosensitive member. The developing device develops the electrostatic latent image into a toner image. The transfer device transfers the toner image from the electrophotographic photosensitive member to a recording medium. In transfer of the toner image from the electrophotographic photosensitive member to the recording medium by the transfer device, the electrophotographic photosensitive member is in contact with the recording medium.

Advantageous Effects of Invention

The electrophotographic photosensitive member of the present invention can inhibit generation of white spots in an image being formed. Also, the process cartridge and the image forming apparatus of the present invention each including such an electrophotographic photosensitive member can inhibit generation of white spots in an image being formed.

DESCRIPTION OF EMBODIMENTS

Figure 1A:
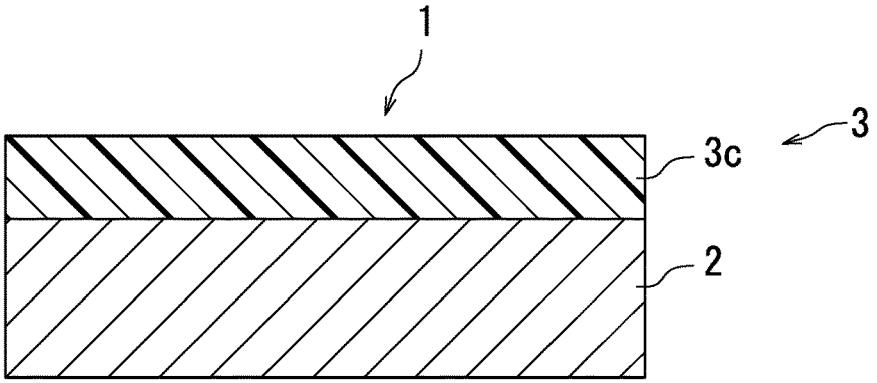
FIG. 1A is a cross-sectional view illustrating an example of an electrophotographic photosensitive member according to an embodiment of the present invention.

The following describes an embodiment of the present invention in detail. However, the present invention is by no means limited to the embodiment described below. The present invention may be practiced with alterations appropriately made within a scope of the objects of the present invention. Note that although some overlapping explanations may be omitted as appropriate, such omission does not limit the gist of the present invention.

In the following description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. Also, reactions represented by reaction formulas (r-a) to (r-d) and (r-a1) to (r-d1) may be referred to as reactions (r-a) to (r-d) and (r-a1) to (r-d1), respectively. Compounds represented by general formulas (1), (2), (A), (B), (B'), (B"), (C), (D), (F), and (G) may be referred to as compounds (1), (2), (A), (B), (B'), (B"), (C), (D), (F), and (G), respectively. Compounds represented by chemical formulas (1-1) to (1-5), (2-1), (CGM-1), (CGM-2), (A-1) to (A-3), (B-1) to (B-5), (C-1) to (C-5), (D-1) to (D-5), (E-1), (E-2), (F-1), and (G-1) may be referred to as compounds (1-1) to (1-5), (2-1), (CGM-1), (CGM-2), (A-1) to (A-3), (B-1) to (B-5), (C-1) to (C-5), (D-1) to (D-5), (E-1), (E-2), (F-1), and (G-1), respectively.

In the following description, a halogen atom, an alkyl group having a carbon number of at least 1 and no greater than 6, an alkyl group having a carbon number of at least 1 and no greater than 8, a cycloalkyl group having a carbon number of at least 3 and no greater than 10, an aryl group having a carbon number of at least 6 and no greater than 14, and an aralkyl group having a carbon number of at least 7 and no greater than 20 mean the followings, unless otherwise stated.

Examples of halogen atoms (halogen groups) include fluorine atom (fluoro group), chlorine atom (chloro group), bromine atom (bromo group), and iodine atom (iodine group).

The alkyl group having a carbon number of at least 1 and no greater than 6 is an unsubstituted straight-chain or branched-chain alkyl group. Examples of alkyl groups having a carbon number of at least 1 and no greater than 6 include methyl group, ethyl group, propyl group, isopropyl group, n-butyl group, sec-butyl group, tert-butyl group, pentyl group, isopentyl group, neopentyl group, and hexyl group.

The alkyl group having a carbon number of at least 1 and no greater than 8 is an unsubstituted straight-chain or branched-chain alkyl group. Examples of alkyl groups having a carbon number of at least 1 and no greater than 8 include methyl group, ethyl group, propyl group, isopropyl group, n-butyl group, sec-butyl group, tert-butyl group, pentyl group, isopentyl group, neopentyl group, hexyl group, heptyl group, and octyl group.

The cycloalkyl group having a carbon number of at least 3 and no greater than 10 is an unsubstituted cycloalkyl group. Examples of cycloalkyl groups having a carbon number of at least 3 and no greater than 10 include cyclopropyl group, cyclobutyl group, cyclopentyl group, cyclohexyl group, cycloheptyl group, cyclooctyl group, cyclononyl group, and cyclodecyl group.

Examples of aryl groups having a carbon number of at least 6 and no greater than 14 include unsubstituted monocyclic aromatic hydrocarbon groups having a carbon number of at least 6 and no greater than 14, unsubstituted condensed bicyclic aromatic hydrocarbon groups having a carbon number of at least 6 and no greater than 14, and unsubstituted condensed tricyclic aromatic hydrocarbon groups having a carbon number of at least 6 and no greater than 14. Examples of aryl groups having a carbon number of at least 6 and no greater than 14 include phenyl group, naphthyl group, anthryl group, and phenanthryl group.

The aralkyl group having a carbon number of at least 7 and no greater than 20 is an unsubstituted aralkyl group. The aralkyl group having a carbon number of at least 7 and no greater than 20 is an alkyl group having a carbon number of at least 1 and no greater than 6 to which an aryl group having a carbon number of at least 6 and no greater than 14 is bonded.

<1. Photosensitive Member>

The present embodiment relates to a photosensitive member. The photosensitive member according to the present embodiment includes a conductive substrate and a photosensitive layer.

Figure 1B:
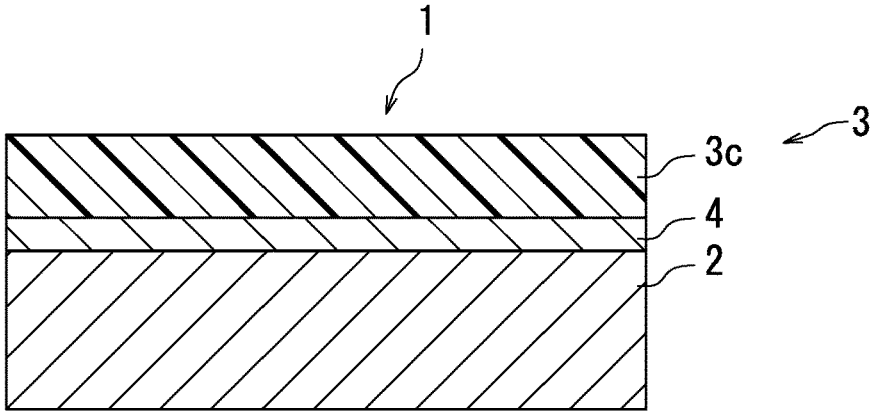
FIG. 1B is a cross-sectional view illustrating an example of the electrophotographic photosensitive member according to the embodiment of the present invention.
Figure 1C:
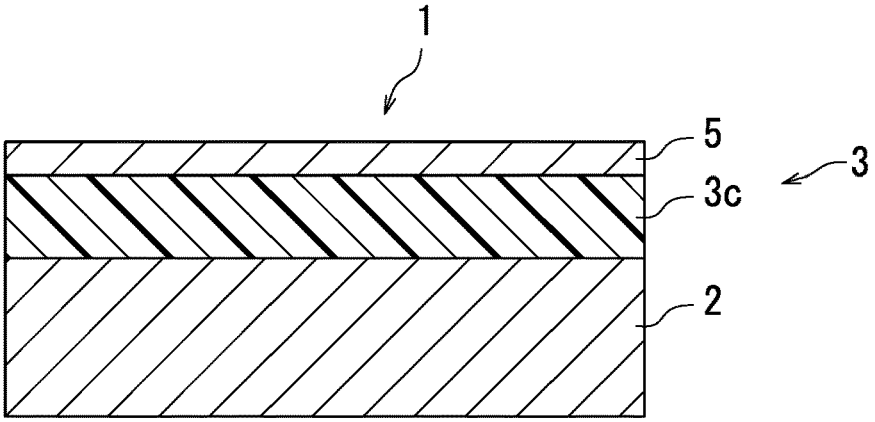
FIG. 1C is a cross-sectional view illustrating an example of the electrophotographic photosensitive member according to the embodiment of the present invention.

The following describes structure of a photosensitive member 1 with reference to FIGS. 1A to 1C. FIGS. 1A to 1C are cross-sectional views each illustrating an example of the photosensitive member 1 according to the present embodiment.

As illustrated in FIG. 1A, the photosensitive member 1 includes for example a conductive substrate 2 and a photosensitive layer 3. The photosensitive member 1 includes a photosensitive layer 3*c* of a single-layer structure (hereinafter referred to as a single-layer photosensitive layer) as the photosensitive layer 3. The photosensitive member 1 including the single-layer photosensitive layer 3*c* is a so-called single-layer photosensitive member.

As illustrated in FIG. 1B, the photosensitive member 1 may include the conductive substrate 2, the single-layer photosensitive layer 3*c*, and an intermediate layer 4 (undercoat layer). The intermediate layer 4 is provided between the conductive substrate 2 and the single-layer photosensitive layer 3*c*. The photosensitive layer 3 may be directly located on the conductive substrate 2, as illustrated in FIG. 1A. Alternatively, the photosensitive layer 3 may be indirectly located on the conductive substrate 2 with the intermediate layer 4 therebetween, as illustrated in FIG. 1B.

As illustrated in FIG. 1C, the photosensitive member 1 may include the conductive substrate 2, the single-layer photosensitive layer 3*c*, and a protective layer 5. The protective layer 5 is provided on the single-layer photosensitive layer 3*c*.

No specific limitation is placed on the thickness of the single-layer photosensitive layer 3*c* so long as the single-layer photosensitive layer 3*c* can sufficiently exhibit its function as a single-layer photosensitive layer. The thickness of the single-layer photosensitive layer 3*c* is preferably at least 5 μm and no greater than 100 μm, and more preferably at least 10 μm and no greater than 50 μm.

The single-layer photosensitive layer 3*c* as the photosensitive layer 3 contains a charge generating material and a compound (1) as an electron transport material. The single-layer photosensitive layer 3*c* may further contain at least one of a hole transport material and a binder resin. The single-layer photosensitive layer 3*c* may contain an additive as necessary. The charge generating material, the electron transport material, and any optionally added component (for example, the hole transport material, the binder resin, or the additive) are contained in the single photosensitive layer 3 (single-layer photosensitive layer 3*c*).

In order to inhibit generation of white spots in an image being formed, the single-layer photosensitive layer 3*c* containing the compound (1) is preferably provided as an outermost layer of the photosensitive member 1.

Through the above, the structure of the photosensitive member 1 has been described with reference to FIGS. 1A to 1C. Next, elements of the photosensitive member will be described.

<1-1. Photosensitive Layer>

The photosensitive layer contains the compound (1) as the electron transport material. An amount of charge of calcium carbonate as measured by charging the calcium carbonate through friction with the photosensitive layer (hereinafter may be simply referred to as an amount of charge of calcium carbonate) is at least +7.0 μC/g. It is inferred that as a result of the above, the photosensitive member of the present embodiment has the following advantages.

In order to facilitate understanding, the following describes a cause of generation of white spots in an image being formed. Upon contact between a recording medium (for example, paper) and the photosensitive member in image formation, minute components of the recording medium (for example, paper dust) may be attached to a surface of the photosensitive member. When the minute components of the recording medium are attached to the surface of the photosensitive member, the minute components may block light with which the photosensitive member is irradiated in a light-exposure process of image formation. The surface potential of the photosensitive member tends not to decrease in a part where the light is blocked by the minute components. Toner tends not to be attached to the part where the surface potential does not sufficiently decrease. As a result, white spots are generated in an image being formed.

Here, it is noted that upon contact between the recording medium (for example, paper) and the photosensitive member in image formation, minute components of the recording medium (for example, paper dust) may be negatively charged or positively charged to a charge level lower than a desired charge level through friction with the photosensitive member. However, the photosensitive layer of the photosensitive member according to the present embodiment contains the compound (1). The compound (1) includes a halogen atom and has a specific chemical structure. Therefore, the compound (1) has high electronegativity. Upon contact between the minute components and the photosensitive member of the present embodiment, the minute components tend to be positively charged to a charge level equal to or higher than the desired charge level through friction with the photosensitive member containing the compound (1) having high electronegativity. In a situation in which the surface of the photosensitive member is positively charged in a charging process of image formation, the positively charged surface of the photosensitive member and the minute components positively charged to the charge level equal to or higher than the desired charge level electrically repel each other. The greater a positive value indicating an amount of charge of the minute components is, the stronger electrical repelling force acting between the surface of the photosensitive member and the minute components becomes. Therefore, the minute components tend not to be attached to the surface of the photosensitive member. As a result, generation of white spots in an image being formed can be inhibited.

Further, the compound (1) includes a moiety represented by Y that is any of —CO—O—$CH_2$—, —CO—, and —CO—O—. The moiety has polarity. Therefore, the compound (1) has improved compatibility with a binder resin (for example, a polycarbonate resin) having a polar group. Improved compatibility facilitates formation of a uniform photosensitive layer. As a result, impairment of electrical characteristics (hereinafter referred to as sensitivity characteristics) of the photosensitive member can be inhibited.

As described above, the amount of charge of calcium carbonate is at least +7.0 μC/g. Calcium carbonate is a main component of paper dust, which is an example of the minute components of the recording medium. When the amount of charge of calcium carbonate is smaller than +7.0 μC/g, positive chargeability of the minute components of the recording medium through friction with the photosensitive member is insufficient. Therefore, white spots tend to be generated in an image being formed. The amount of charge of calcium carbonate is preferably at least +7.0 μC/g and no greater than +15.0 μC/g, more preferably at least +8.0 μC/g and no greater than +9.5 μC/g, and further preferably at least +9.0 μC/g and no greater than +9.5 μC/g.

Figure 2:
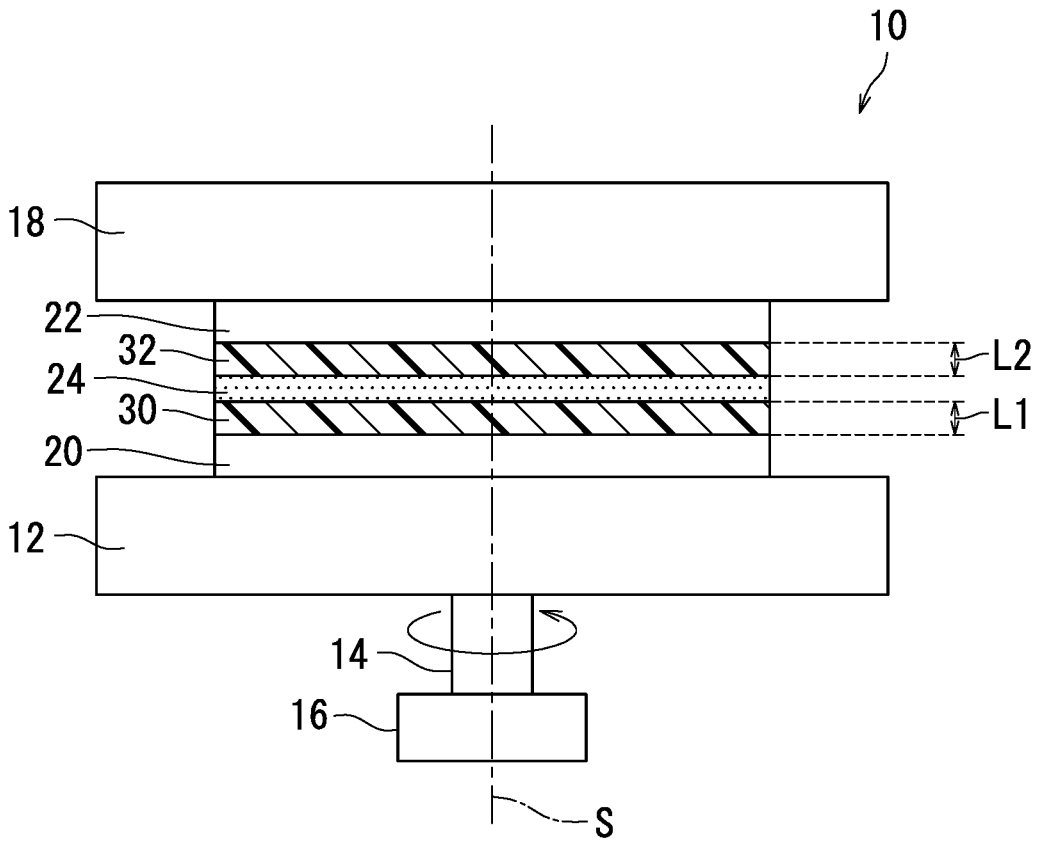
FIG. 2 is a diagram for explaining a method for measuring an amount of charge of calcium carbonate by charging the calcium carbonate through friction with a photosensitive layer.

The following describes with reference to FIG. 2 a method for measuring an amount of charge of calcium carbonate by charging the calcium carbonate through friction with the photosensitive layer 3. The amount of charge of calcium carbonate is measured through first through fourth steps. In the first step, two photosensitive layers 3 are prepared. One of the two photosensitive layers 3 is a first photosensitive layer 30. The other of the two photosensitive layers 3 is a second photosensitive layer 32. The first photosensitive layer 30 and the second photosensitive layer 32 each have a circular shape with a diameter of 3 cm. In the second step, 0.007 g of calcium carbonate is applied over the first photosensitive layer 30. Through the above, a calcium carbonate layer 24 made from the calcium carbonate is formed. Subsequently, the second photosensitive layer 32 is placed on the calcium carbonate layer 24. In the third step, the first photosensitive layer 30 is rotated at a rotational speed of 60 rpm for 60 seconds while the second photosensitive layer 32 is fixed in an environment at a temperature of 23° C. and a relative humidity of 50%. Through the above, the calcium carbonate contained in the calcium carbonate layer 24 is charged through friction with the first photosensitive layer 30 and the second photosensitive layer 32. In the fourth step, the charged calcium carbonate is sucked using a charge measuring device. A total electric amount Q and a mass M of the sucked calcium carbonate are measured using the charge measuring device, and the amount of charge of calcium carbonate is calculated according to an expression Q/M. Note that a specific method for measuring the amount of charge of calcium carbonate will be described in Examples. Through the above, the method for measuring the amount of charge of calcium carbonate by charging the calcium carbonate through friction with the photosensitive layer 3 has been described with reference to FIG. 2.

(Electron Transport Material)

The electron transport material includes the compound (1). The electron transport material transports electrons for example in the single-layer photosensitive layer and gives a bipolar property (bipolarity) to the single-layer photosensitive layer. As a result of the compound (1) being contained as the electron transport material in the single-layer photosensitive layer, minute components of the recording medium (for example, paper dust) can be positively charged to the desired charge level through friction with the photosensitive member containing the compound (1) having high electronegativity upon contact between paper and the photosensitive member.

The compound (1) is represented by general formula (1) shown below. The compound (1) is a naphthoquinone derivative.

(1)

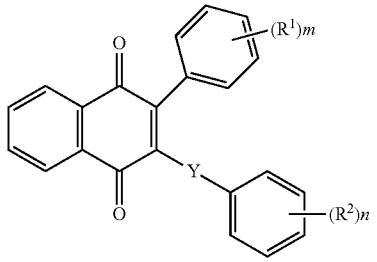

In general formula (1), $R^1$ and $R^2$ each represent, independently of each other: a halogen atom; an alkyl group having a carbon number of at least 1 and no greater than 8 and having at least one halogen atom; an aryl group having a carbon number of at least 6 and no greater than 14, having at least one halogen atom, and optionally having an alkyl group having a carbon number of at least 1 and no greater than 6; an aralkyl group having a carbon number of at least 7 and no greater than 20 and having at least one halogen atom; or a cycloalkyl group having a carbon number of at least 3 and no greater than 10 and having at least one halogen atom. Also, m and n each represent, independently of each other, an integer of at least 0 and no greater than 5, with the proviso that at least one of the integers represented by m and n is not 0. Accordingly, the compound (1) includes a halogen atom as an essential constituent. Y represents —CO—O—$CH_2$—, —CO—, or —CO—O—.

The halogen atom (halogen group) represented by any of $R^1$ and $R^2$ is preferably a chlorine atom (chloro group) or a fluorine atom (fluoro group).

The alkyl group having a carbon number of at least 1 and no greater than 8 represented by any of $R^1$ and $R^2$ is preferably an alkyl group having a carbon number of at least 1 and no greater than 6. The alkyl group having a carbon number of at least 1 and no greater than 8 represented by $R^1$ has at least one halogen atom. The at least one halogen atom included in the alkyl group having a carbon number of at least 1 and no greater than 8 represented by $R^1$ is each preferably a chlorine atom (chloro group) or a fluorine atom (fluoro group). The number of halogen atoms included in the alkyl group having a carbon number of at least 1 and no greater than 8 represented by $R^1$ is preferably at least 1 and no greater than 17, and more preferably 1 or 2.

The aryl group having a carbon number of at least 6 and no greater than 14 represented by any of $R^1$ and $R^2$ is preferably a phenyl group. The aryl group having a carbon number of at least 6 and no greater than 14 represented by $R^1$ has at least one halogen atom. The at least one halogen atom included in the aryl group having a carbon number of at least 6 and no greater than 14 represented by $R^1$ is each preferably a chlorine atom (chloro group) or a fluorine atom (fluoro group). The number of halogen atoms included in the aryl group having a carbon number of at least 6 and no greater than 14 represented by $R^1$ is preferably at least 1 and no greater than 10, and more preferably 1 or 2. The aryl group having a carbon number of at least 6 and no greater than 14 may further have an alkyl group having a carbon number of at least 1 and no greater than 6 in addition to the at least one halogen atom. The alkyl group having a carbon number of at least 1 and no greater than 6 included in the aryl group having a carbon number of at least 6 and no greater than 14 is preferably an alkyl group having a carbon number of at least 1 and no greater than 3.

The aralkyl group having a carbon number of at least 7 and no greater than 20 represented by any of $R^1$ and $R^2$ is preferably an alkyl group having a carbon number of at least 1 and no greater than 6 and having a phenyl group. The aralkyl group having a carbon number of at least 7 and no greater than 20 represented by $R^1$ has at least one halogen atom. The at least one halogen atom included in the aralkyl group having a carbon number of at least 7 and no greater than 20 represented by $R^1$ is each preferably a chlorine atom (chloro group) or a fluorine atom (fluoro group). The number of halogen atoms included in the aralkyl group having a carbon number of at least 7 and no greater than 20 represented by $R^1$ is preferably at least 1 and no greater than 22, and more preferably 1 or 2.

The cycloalkyl group having a carbon number of at least 3 and no greater than 10 represented by any of $R^1$ and $R^2$ has at least one halogen atom. The at least one halogen atom included in the cycloalkyl group having a carbon number of at least 3 and no greater than 10 represented by $R^1$ is each preferably a chlorine atom (chloro group) or a fluorine atom (fluoro group). The number of halogen atoms included in the cycloalkyl group having a carbon number of at least 3 and no greater than 10 represented by $R^1$ is preferably at least 1 and no greater than 19, and more preferably 1 or 2.

Further, m and n each represent, independently of each other, an integer of at least 0 and no greater than 5, with the proviso that at least one of the integers represented by m and n is not 0. A sum of the integers represented by m and n is preferably at least 1 and no greater than 10 (that is, 1≤m+ n≤10), and more preferably at least 1 and no greater than 2 (that is, 1≤m+n≤2). In order to favorably inhibit generation of white spots in an image being formed, m preferably represents 0. In order to favorably inhibit generation of white spots in an image being formed, n preferably represents 1 or 2, and more preferably 2. The greater the number of halogen atoms included in $R^1$ is, the more likely it is that the minute components of the recording medium (for example, paper dust) have a large amount of charge of the same polarity as the charging polarity of the photosensitive member as a result of friction between the minute components and the photosensitive member.

In general formula (1), the binding site (substitution site) of $R^1$ is not specifically limited. $R^1$ may be bound at any of an ortho position, a meta position, and a para position of the phenyl group. When m represents an integer of at least 2 and no greater than 5, a plurality of chemical groups $R^1$ may be the same as or different from one another.

In general formula (1), the binding site (substitution site) of $R^2$ is not specifically limited. $R^2$ may be bound at any of an ortho position, a meta position, and a para position of the phenyl group. When n represents an integer of at least 2 and no greater than 5, a plurality of chemical groups $R^2$ may be the same as or different from one another. When n represents 1, $R^2$ is preferably bound at the para position of the phenyl group. When n represents 2, the two chemical groups $R^2$ are preferably bound to the ortho position and the para position of the phenyl group or the two chemical groups $R^2$ are preferably bound to the meta position and the para position of the phenyl group.

Y represents —CO—O—$CH_2$—, —CO—, or —CO—O—. The carbonyl group of any of CO—O—$CH_2$—, —CO—, and —CO—O— is bonded to a naphthoquinone moiety in general formula (1). In order to favorably inhibit generation of white spots in an image being formed, Y preferably represents —CO—O—$CH_2$— or —CO—. In order to achieve favorable inhibition of generation of white spots in an image being formed and improvement of sensitivity characteristics of the photosensitive member at the same time, Y more preferably represents —CO—O—$CH_2$—.

In order to favorably inhibit generation of white spots in an image being formed, it is preferable that in general formula (1), m represents 0 and Y represents —CO—O—$CH_2$— or —CO—.

In order to favorably inhibit generation of white spots in an image being formed, it is more preferable that in general formula (1), m represents 0, Y represents —CO—O—CH2- or —CO—, $R^2$ represents a halogen atom, and n represents 1 or 2.

Specific examples of the compound (1) include compounds (1-1) to (1-5). The compounds (1-1) to (1-5) are respectively represented by chemical formulas (1-1) to (1-5) shown below.

(1-1)

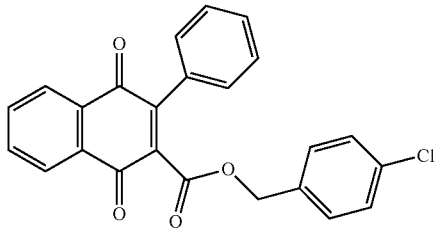

-continued (1-2)

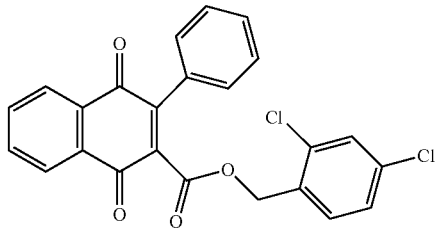

(1-3)

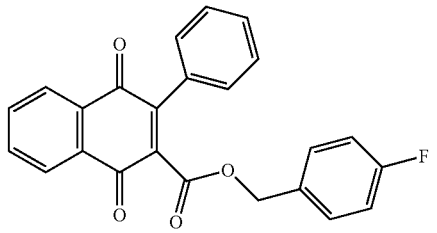

(1-4)

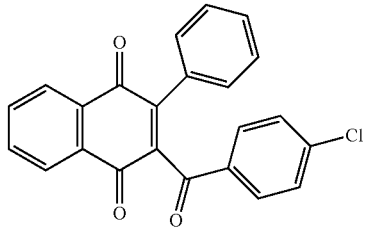

(1-5)

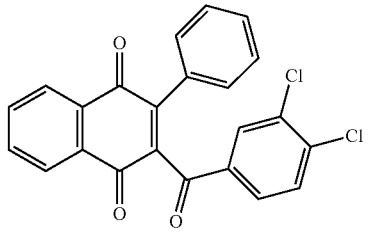

[Production Method of Compound (1)]

The compound (1) is produced for example by the following reactions (r-a) to (r-d) or a method in accordance therewith. A process other than these reactions may be included as necessary. In reaction formulas representing the reactions (r-a) to (r-d), R', $R^2$, m, n, and Y are the same as R', $R^2$, m, n, and Y in general formula (1), respectively. In the reaction formulas representing the reactions (r-a) to (r-d), X represents a halogen atom.

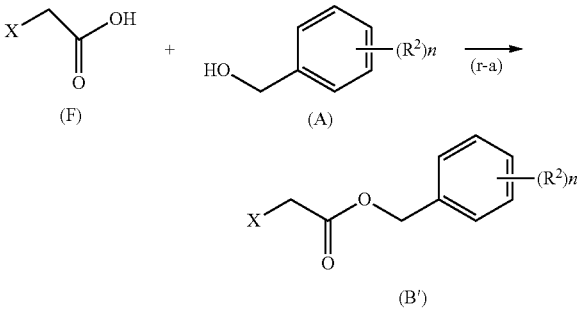

In the reaction (r-a), a compound (B') to be used in the reaction (r-b) described later is produced. The compound (B') is a compound represented by general formula (B) where Y represents —CO—O—$CH_2$—. In the reaction (r-a), 1 mole equivalent of a compound (F) and 1 mole equivalent of a compound (A) are reacted to obtain 1 mole equivalent of the compound (B'). Preferably, at least 1 mole and no greater than 5 moles of the compound (A) is added relative to 1 mole of the compound (F). Preferably, the reaction (r-a) is caused at a reaction temperature of at least 0° C. and no higher than 50° C. Preferably, the reaction (r-a) is caused for a reaction time of at least 3 hours and no longer than 10 hours.

A dehydration condensation agent may be used in the reaction (r-a). Examples of dehydration condensation agents include N,N'-dicyclohexylcarbodiimide (DCC), 1-hydroxybenzotriazole (HOBT), water-soluble carbodiimide (WSCD), diphenyl azidophosphate (DPPA), benzotriazol-1-yloxy-trisdimethylaminophosphonium salt (BOP), (benzotriazol-1-yloxy)tripyrrolidinophosphonium hexafluorophosphate (PyBOP), 2-chloro-4,6-dimethoxytriazine (CDMT), 2,4,6-trichlorobenzoylchloride, and 2-methyl-6-nitrobenzoic anhydride (MNBA). The amount of the dehydration condensation agent is preferably at least 1 mole and no greater than 3 moles relative to 1 mole of the compound (F).

The reaction (r-a) may be caused in a solvent. Examples of solvents include diethyl ether, chloroform, dichloromethane, acetone, and ethyl acetate.

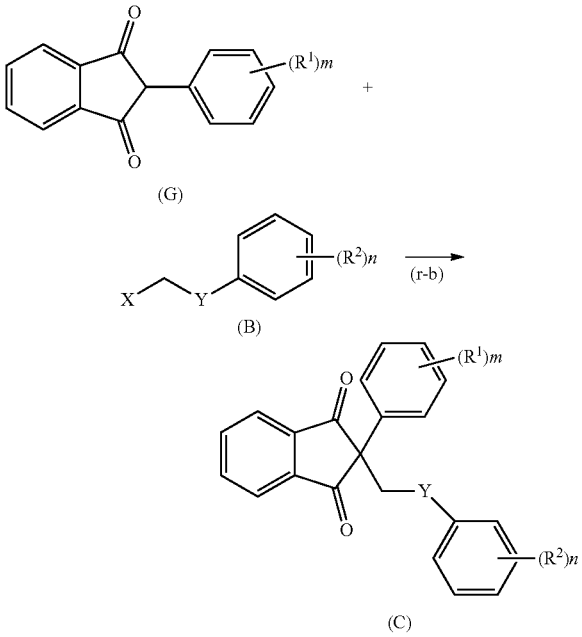

In the reaction (r-b), 1 mole equivalent of a compound (G) and 1 mole equivalent of a compound (B) are reacted to obtain 1 mole equivalent of a compound (C). The compound (B) used in the reaction (r-b) is the compound (B'), a compound (B"), or a compound (B'") shown below. The compound (B') is represented by general formula (B) where Y represents —CO—O—$CH_2$—. The compound (B") is represented by general formula (B) where Y represents —CO—. The compound (B'") is represented by general formula (B) where Y represents —CO—O—. The compound (B') can be synthesized by the reaction (r-a). The compounds (B") and (B'") may each be synthesized by a known method. Alternatively, commercially available products may be used as the compounds (B") and (B'").

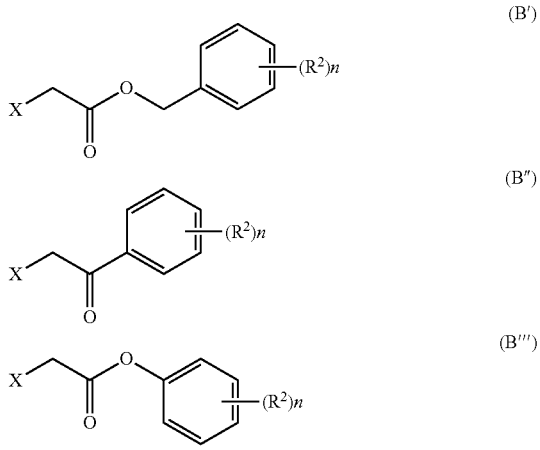

In the reaction (r-b), preferably at least 1 mole and no greater than 5 moles of the compound (B) is added relative to 1 mole of the compound (G). Preferably, the reaction (r-b) is caused at a reaction temperature of at least 70° C. and no higher than 100° C. Preferably, the reaction (r-b) is caused for a reaction time of at least 2 hours and no longer than 6 hours.

A base may be used in the reaction (r-b). Examples of bases include sodium alkoxides (specific examples include sodium methoxide and sodium ethoxide), metal hydrides (specific examples include sodium hydride and potassium hydride), and n-butyl lithium. The amount of the base is preferably at least 1 mole and no greater than 2 moles relative to 1 mole of the compound (G).

The reaction (r-b) may be caused in a solvent. Examples of solvents include tetrahydrofuran, acetone, acetonitrile, N,N-dimethylformamide, and dimethyl sulfoxide.

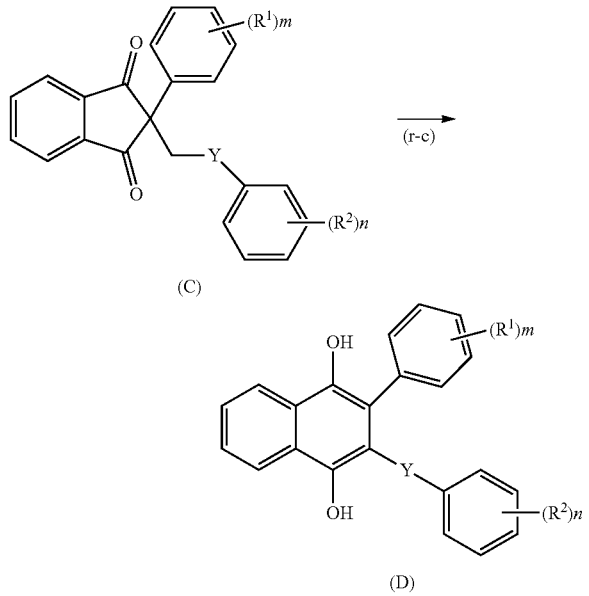

In the reaction (r-c), 1 mole equivalent of a compound (D) is obtained from 1 mole equivalent of the compound (C) in the presence of a base. Preferably, the reaction (r-c) is caused at a reaction temperature of at least 70° C. and no higher than 100° C. Preferably, the reaction (r-c) is caused for a reaction time of at least 2 hours and no longer than 6 hours.

Examples of bases that can be used in the reaction (r-c) include sodium alkoxides (specific examples include sodium methoxide and sodium ethoxide), metal hydrides (specific examples include sodium hydride and potassium hydride), and n-butyl lithium. The amount of the base is preferably at least 1 mole and no greater than 2 moles relative to 1 mole of the compound (G).

The reaction (r-b) may be caused in a solvent. Examples of solvents include tetrahydrofuran, acetone, acetonitrile, N,N-dimethylformamide, and dimethyl sulfoxide.

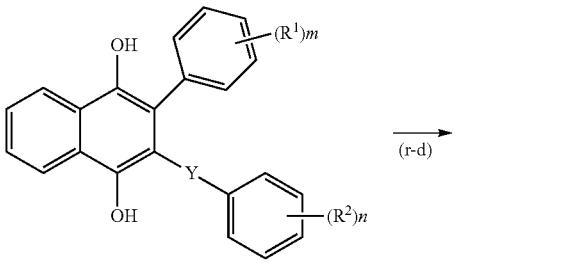

(D)

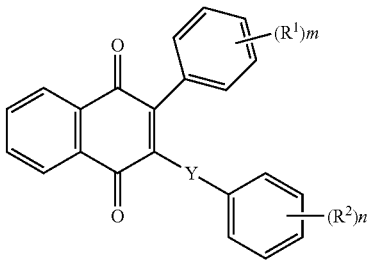

(1)

In the reaction (r-d), 1 mole equivalent of a compound (1) is obtained from 1 mole equivalent of the compound (D) in the presence of an oxidant. Preferably, the reaction (r-d) is caused at a reaction temperature of at least 0° C. and no higher than 50° C. Preferably, the reaction (r-d) is caused for a reaction time of at least 2 hours and no longer than 10 hours.

Examples of oxidants that can be used in the reaction (r-d) include chloranil and potassium permanganate. The amount of the oxidant is preferably at least 1 mole and no greater than 3 moles relative to 1 mole of the compound (D).

The single-layer photosensitive layer may contain only the compound (1) as the electron transport material. Alternatively, the single-layer photosensitive layer may further contain an electron transport material other than the compound (1) (hereinafter referred to as an additional electron transport material) in addition to the compound (1). Examples of additional electron transport materials include quinone-based compounds, diimide-based compounds, hydrazone-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone-based compounds include diphenoquinone-based compounds, azoquinone-based compounds, anthraquinone-based compounds, naphthoquinone-based compounds, nitroanthraquinone-based compounds, and dinitroanthraquinone-based compounds. One electron transport material may be used independently or two or more electron transport materials may be used in combination. The amount of the compound (1) is preferably at least 80% by mass relative to a total mass of the electron transport material(s), more preferably at least 90% by mass, and particularly preferably 100% by mass.

The amount of the compound (1) as the electron transport material is preferably at least 20 parts by mass and no greater than 40 parts by mass relative to 100 parts by mass of a binder resin. When the amount of the compound (1) is at least 20 parts by mass relative to 100 parts by mass of the binder resin, sensitivity characteristics of the photosensitive member can be easily improved. When the amount of the compound (1) is no greater than 40 parts by mass relative to 100 parts by mass of the binder resin, the compound (1) readily dissolves in a solvent for photosensitive layer formation, facilitating formation of a uniform photosensitive layer.

(Charge Generating Material)

The single-layer photosensitive layer as the photosensitive layer contains the charge generating material. No specific limitation is placed on the charge generating material so long as the charge generating material can be used in the photosensitive member. Examples of charge generating materials include phthalocyanine-based pigments, perylene-based pigments, bisazo pigments, tris-azo pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (specific examples include selenium, selenium-tellurium, selenium-arsenic, cadmium sulfide, and amorphous silicon), pyrylium pigments, anthanthrone-based pigments, triphenylmethane-based pigments, threne-based pigments, toluidine-based pigments, pyrazoline-based pigments, and quinacridone-based pigments. One charge generating material may be used independently or two or more charge generating materials may be used in combination.

Examples of phthalocyanine-based pigments include a metal-free phthalocyanine represented by chemical formula (CGM-1) and metal phthalocyanines. Examples of metal phthalocyanines include a titanyl phthalocyanine represented by chemical formula (CGM-2), hydroxygallium phthalocyanine, and chlorogallium phthalocyanine. The phthalocyanine-based pigments may be crystalline or non-crystalline. No specific limitation is placed on the crystal form (specific examples include α-form, β-form, Y-form, V-form, and II-form) of the phthalocyanine-based pigments. Phthalocyanine-based pigments having various crystal forms can be used.

(CGM-1)

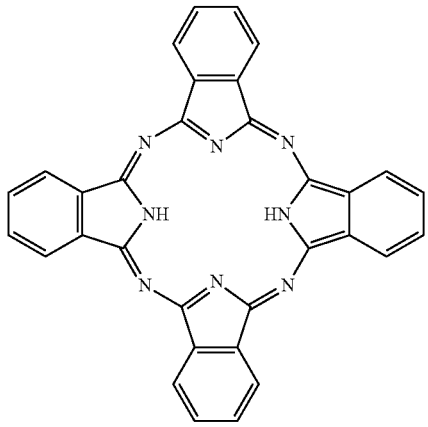

(CGM-2)

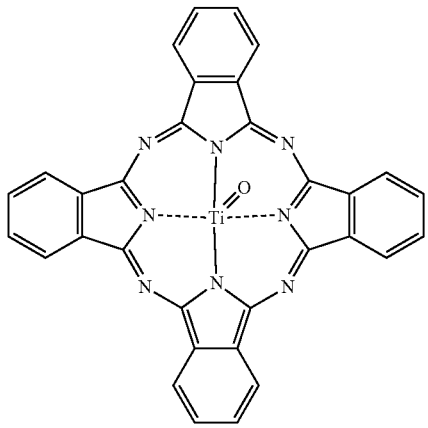

Examples of crystalline metal-free phthalocyanines include a metal-free phthalocyanine having an X-form crystal structure (hereinafter may be referred to as an X-form metal-free phthalocyanine). Examples of crystalline titanyl phthalocyanines include titanyl phthalocyanines respectively having α-form, β-form, and Y-form crystal structures (hereinafter may be referred to as an α-form titanyl phthalocyanine, a β-form titanyl phthalocyanine, and a Y-form titanyl phthalocyanine, respectively). Examples of crystalline hydroxygallium phthalocyanines include a hydroxygallium phthalocyanine having a V-form crystal structure. Examples of crystalline chlorogallium phthalocyanines include a chlorogallium phthalocyanine having a II-form crystal structure.

For image forming apparatuses employing, for example, a digital optical system (for example, a laser beam printer or facsimile machine including a light source such as a semiconductor laser), a photosensitive member having sensitivity in a wavelength range of at least 700 nm is preferably used. Phthalocyanine-based pigments are preferable as the charge generating material in terms of their high quantum yield in the wavelength range of at least 700 nm. Metal-free phthalocyanines and titanyl phthalocyanines are more preferable. The X-form metal-free phthalocyanine and the Y-form titanyl phthalocyanine are further preferable. In a configuration in which the compound (1) is contained as a hole transport material in the photosensitive layer, the Y-form titanyl phthalocyanine is more preferable as the charge generating material in order to significantly improve sensitivity characteristics.

The Y-form titanyl phthalocyanine has a main peak for example at a Bragg angle (2θ±0.2°) of 27.2° in a CuKα characteristic X-ray diffraction spectrum. The main peak in the CuKα characteristic X-ray diffraction spectrum is the most intensive or the second most intensive peak in a Bragg angle (20±0.2°) range from 3° to 40°.

The following describes an example of a method for measuring the CuKα characteristic X-ray diffraction spectrum. A sample (titanyl phthalocyanine) is loaded into a sample holder of an X-ray diffractometer (for example, "RINT (registered Japanese trademark) 1100" manufactured by Rigaku Corporation) and an X-ray diffraction spectrum is measured using a Cu X-ray tube under conditions of: a tube voltage of 40 kV; a tube current of 30 mA; and a wavelength of CuKα characteristic X ray of 1.542 Å. The measurement range (20) is for example from 3° to 40° (start angle: 3°, stop angle: 40°), and the scanning speed is for example 10°/minute.

For photosensitive members adopted in image forming apparatuses including a short-wavelength laser light source (for example, a laser light source having a wavelength of at least 350 nm and no longer than 550 nm), an anthanthrone-based pigment is preferably used as the charge generating material.

The amount of the charge generating material is preferably at least 0.1 parts by mass and no greater than 50 parts by mass relative to 100 parts by mass of the binder resin contained in the single-layer photosensitive layer, more preferably at least 0.5 parts by mass and no greater than 30 parts by mass, and particularly preferably at least 0.5 parts by mass and no greater than 4.5 parts by mass.

(Hole Transport Material)

The single-layer photosensitive layer contains for example a hole transport material. Examples of hole transport materials include triphenylamine derivatives, diamine derivatives (specific examples include N,N,N',N'-tetraphenylbenzidine derivative, N,N,N',N'-tetraphenylphenylenediamine derivative, N,N,N',N'-tetraphenylnaphthylenediamine derivative, N,N,N',N'-tetraphenylphenantolylenediamine derivative, and di(aminophenylethenyl)benzene derivative), oxadiazole-based compounds (specific examples include 2,5-di(4-methylaminophenyl)-1,3,4-oxadiazole), styryl-based compounds (specific examples include 9-(4-diethylaminostyryl)anthracene), carbazole-based compounds (specific examples include polyvinyl carbazole), organic polysilane compounds, pyrazoline-based compounds (specific examples include 1-phenyl-3-(p-dimethylaminophenyl)pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds. One hole transport material may be used independently or two or more hole transport materials may be used in combination.

An example of hole transport materials is a compound (2). The compound (2) is represented by general formula (2) shown below.

(2)

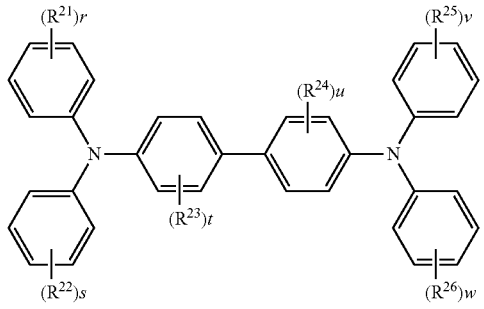

In general formula (2), $R^{21}$ to $R^{26}$ each represent, independently of one another, an alkyl group having a carbon number of at least 1 and no greater than 6 or an alkoxy group having a carbon number of at least 1 and no greater than 6. Also, r, s, v, and w each represent, independently of one another, an integer of at least 0 and no greater than 5. Further, t and u each represent, independently of each other, an integer of at least 0 and no greater than 4.

In general formula (2), $R^{21}$ to $R^{26}$ each preferably represent, independently of one another, an alkyl group having a carbon number of at least 1 and no greater than 6, and more preferably a methyl group. Preferably, r, s, v, and w each represent, independently of one another, 0 or 1. Preferably, t and u each represent, independently of each other, 0 or 1.

A specific example of the compound represented by general formula (2) is a compound (2-1). The compound (2-1) is represented by chemical formula (2-1) shown below.

(2-1)

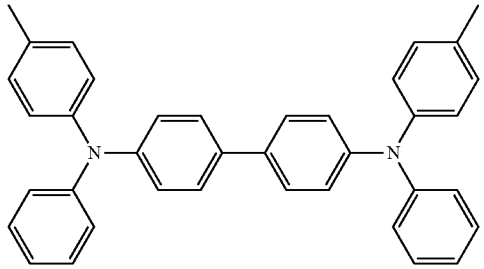

The amount of the hole transport material contained in the single-layer photosensitive layer is preferably at least 10 parts by mass and no greater than 200 parts by mass relative to 100 parts by mass of the binder resin, and more preferably at least 10 parts by mass and no greater than 100 parts by mass.

(Binder Resin)

The single-layer photosensitive layer contains the binder resin. Examples of binder resins include thermoplastic resins, thermosetting resins, and photocurable resins. Examples of thermoplastic resins include polycarbonate resins, polyarylate resins, styrene-butadiene copolymers, styrene-acrylonitrile copolymers, styrene-maleic acid copolymers, acrylic acid polymers, styrene-acrylic acid copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, urethane resins, polysulfone resins, diallyl phthalate resins, ketone resins, polyvinyl butyral resins, polyester resins, and polyether resins. Examples of thermosetting resins include silicone resins, epoxy resins, phenolic resins, urea resins, and melamine resins. Examples of photocurable resins include epoxy acrylates (acrylic acid adducts of epoxy compounds) and urethane acrylates (acrylic acid adducts of urethane compounds). One of the above-listed binder resins may be used independently or two or more of the above-listed binder resins may be used in combination.

Among the above-listed resins, a polycarbonate resin is preferable in terms of obtaining a single-layer photosensitive layer excellent in balance among processability, mechanical characteristics, optical properties, and abrasion resistance. Examples of polycarbonate resins include a bisphenol ZC polycarbonate resin, a bisphenol C polycarbonate resin, and a bisphenol A polycarbonate resin. A resin represented by general formula (3) shown below (hereinafter may be referred to as a resin (3)) is preferably used as the polycarbonate resin.

(3)

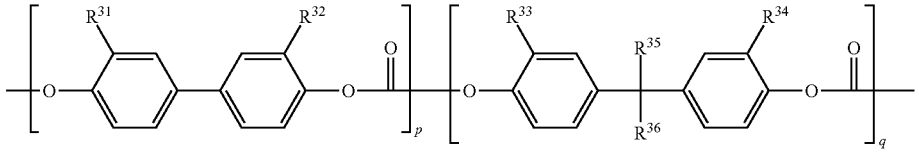

In general formula (3), $R^{31}$ to $R^{36}$ each represent, independently of one another, a hydrogen atom, an alkyl group having a carbon number of at least 1 and no greater than 6, or an aryl group having a carbon number of at least 6 and no greater than 14. $R^{35}$ and $R^{36}$ may be bonded to each other to represent a cycloalkylidene group having a carbon number of at least 5 and no greater than 7. Further, the following expressions are satisfied: $p+q=1.00$ and $0.00 \leq p \leq 0.90$.

The alkyl group having a carbon number of at least 1 and no greater than 6 represented by any of $R^{31}$ to $R^{36}$ in general formula (3) is preferably an alkyl group having a carbon number of at least 1 and no greater than 4, and more preferably a methyl group.

The aryl group having a carbon number of at least 6 and no greater than 14 represented by any of $R^{31}$ to $R^{36}$ in general formula (3) is preferably a phenyl group.

In general formula (3), $R^{31}$, $R^{32}$, $R^{33}$, and $R^{34}$ each preferably represent an alkyl group having a carbon number of at least 1 and no greater than 6 or a hydrogen atom, more preferably a hydrogen atom or a methyl group, and further preferably a hydrogen atom. $R^{35}$ and $R^{36}$ are preferably bonded to each other to represent a cycloalkylidene group having a carbon number of at least 5 and no greater than 7, and more preferably bonded to each other to represent a cyclohexylidene group.

In general formula (3), it is preferable that $R_{31}$, $R_{32}$, $R_{33}$, and $R_{34}$ each represent a hydrogen atom and $R_{35}$ and $R_{36}$ are bonded to each other to represent a cyclohexylidene group. In general formula (3), it is more preferable that: $R_{31}$, $R_{32}$, $R_{33}$, and $R_{34}$ each represent a hydrogen atom; $R_{35}$ and $R_{36}$ are bonded to each other to represent a cyclohexylidene group; p represents a numerical value of at least 0.30 and no greater than 0.70; q represents a numerical value of at least 0.30 and no greater than 0.70; and m+n=1.00.

In general formula (3), it is also preferable that: p represents 0.00; q represents 1.00; $R_{33}$ and $R_{34}$ each represent a hydrogen atom; and $R_{35}$ and $R_{36}$ are bonded to each other to represent a cyclohexylidene group.

The resin (3) includes a repeating unit represented by general formula (3a) (hereinafter may be referred to as a repeating unit (3a)) and a repeating unit represented by general formula (3b) (hereinafter referred to as a repeating unit (3b)). Note that $R^{31}$ and $R^{32}$ in general formula (3a) are the same as $R^{31}$ and $R^{32}$ in general formula (3), respectively. Also, $R^{33}$, $R^{34}$, $R^{35}$, and $R^{36}$ in general formula (3b) are the same as $R^{33}$, $R^{34}$, $R^{35}$, and $R^{36}$ in general formula (3), respectively.

(3a)

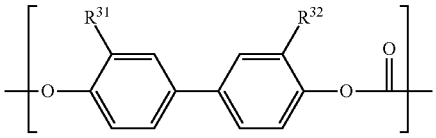

-continued (3b)

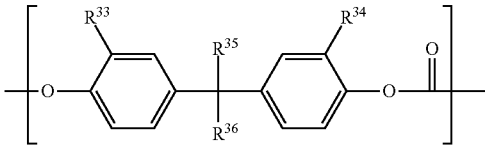

In general formula (3), p represents a ratio (mole fraction) of an amount of substance (the number of moles) of the repeating unit (3a) to a total amount of substance (a total number of moles) of the repeating unit (3a) and the repeating unit (3b) included in the resin (3). Also, q represents a ratio (mole fraction) of an amount of substance (the number of moles) of the repeating unit (3b) to the total amount of substance (the total number of moles) of the repeating unit (3a) and the repeating unit (3b) included in the resin (3). Preferably, $0.00 \leq p \leq 0.70$, and more preferably, $0.00 \leq p \leq 0.40$. It is also preferable that p=0.00 or $0.30 \leq p \leq 0.70$.

The resin (3) may be a random copolymer formed through random copolymerization of the repeating unit (3a) and the repeating unit (3b). Alternatively, the resin (3) may be an alternate copolymer formed through alternate copolymerization of the repeating unit (3a) and the repeating unit (3b). Alternatively, the resin (3) may be a periodic copolymer formed through periodic copolymerization of at least one repeating unit (3a) and at least one repeating unit (3b). Alternatively, the resin (3) may be a block copolymer formed through copolymerization of a block of a plurality of repeating units (3a) and a block of a plurality of repeating units (3b).

Specific examples of the resin (3) include polycarbonate resins represented by chemical formulas (3-1) and (3-2) shown below. The polycarbonate resin represented by chemical formula (3-1) is a resin represented by general formula (3) where p represents 0.00 and q represents 1.00. The polycarbonate resin represented by chemical formula (3-1) is constituted by the repeating unit (3b) only. The polycarbonate resin represented by chemical formula (3-2) is a resin represented by general formula (3) where p represents 0.40 and q represents 0.60.

(3-1)

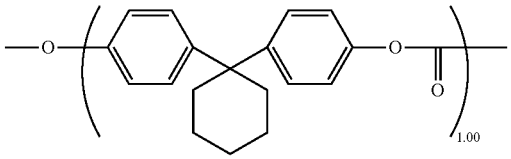

(3-2)

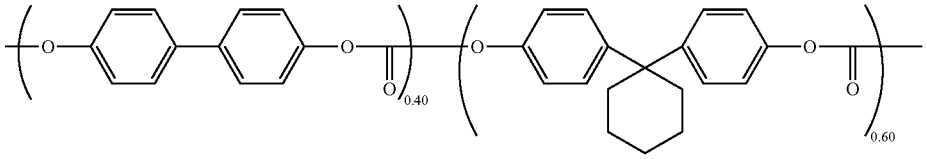

The viscosity average molecular weight of the binder resin is preferably at least 25,000, and more preferably at least 25,000 and no greater than 52,500. When the viscosity average molecular weight of the binder resin is at least 25,000, abrasion resistance of the photosensitive member can be easily improved. When the viscosity average molecular weight of the binder resin is no greater than 52,500, the binder resin readily dissolves in a solvent used in photosensitive layer formation and an application liquid for single-layer photosensitive layer formation does not have an excessively high viscosity. As a result, formation of the single-layer photosensitive layer is facilitated.

No specific limitation is placed on a method for producing the binder resin so long as the resin (3) can be produced. An example of methods for producing the resin (3) is a method (so-called phosgene method) of causing condensation polymerization of diol compounds and phosgene for forming repeating units of the polycarbonate resin. More specifically, the resin (3) is produced for example by a method of causing condensation polymerization among a diol compound represented by general formula (3c), a diol compound represented by general formula (3d), and phosgene. Note that $R^{31}$ and $R^{32}$ in general formula (3c) are the same as $R^{31}$ and $R^{32}$ in general formula (3), respectively. Also, $R^{33}$, $R^{34}$, $R^{35}$, and $R^{36}$ in general formula (3d) are the same as $R^{33}$, $R^{34}$, $R^{35}$, and $R^{36}$ in general formula (3), respectively. Another example of methods for producing the resin (3) is a method of causing an ester exchange reaction between diol compounds and diphenyl carbonate.

(3c)

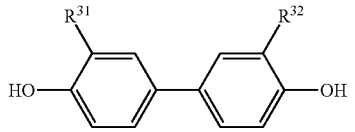

(3d)

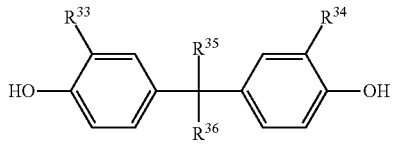

(Additive)

The single-layer photosensitive layer may contain an additive as necessary. Examples of additives include antidegradants (specific examples include antioxidants, radical scavengers, singlet quenchers, and ultraviolet absorbing agents), softeners, surface modifiers, extenders, thickeners, dispersion stabilizers, waxes, acceptors, donors, surfactants, plasticizers, sensitizers, and leveling agents. Examples of antioxidants include hindered phenols (specific examples include di(tert-butyl)p-cresol), hindered amine, paraphenylenediamine, arylalkane, hydroquinone, spirochromane, spiroindanone, derivatives of the aforementioned compounds, organosulfur compounds, and organophosphorus compounds.

<1-2. Conductive Substrate>

No specific limitation is placed on the conductive substrate so long as the conductive substrate can be used in the photosensitive member. It is only required that at least a surface portion of the conductive substrate be formed from an electrically conductive material. An example of the conductive substrate is a substrate formed from an electrically conductive material. Another example of the conductive substrate is a substrate coated with an electrically conductive material. Examples of electrically conductive materials include aluminum, iron, copper, tin, platinum, silver, vanadium, molybdenum, chromium, cadmium, titanium, nickel, palladium, indium, stainless steel, and brass. One of the above-listed electrically conductive materials may be used independently or two or more of the above-listed electrically conductive materials may be used in combination (for example, as an alloy). Among the above-listed electrically conductive materials, aluminum or an aluminum alloy is preferable in terms of favorable charge mobility from the photosensitive layer to the conductive substrate.

The shape of the conductive substrate is appropriately selected according to a configuration of an image forming apparatus. Examples of the shape of the conductive substrate include a sheet-like shape and a drum-like shape. Also, the thickness of the conductive substrate is appropriately selected according to the shape of the conductive substrate.

<1-3. Intermediate Layer>

The intermediate layer (undercoat layer) contains for example inorganic particles and a resin for intermediate layer use (an intermediate layer resin). An electric current generated when the photosensitive member is irradiated with light is thought to flow smoothly in the presence of the intermediate layer, resulting in suppression of an increase in resistance while insulation is maintained to such an extent that occurrence of a leakage current can be prevented.

Examples of inorganic particles include particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). One type of the above-listed inorganic particles may be used independently or two or more types of the above-listed inorganic particles may be used in combination.

No specific limitation is placed on the intermediate layer resin so long as it can be used for intermediate layer formation. The intermediate layer may contain an additive. Examples of additives that may be contained in the intermediate layer are the same as the examples of the additives that may be contained in the photosensitive layer.

<1-4. Method for Producing Photosensitive Member>

The photosensitive member is produced for example as described below. The photosensitive member is produced by applying an application liquid for single-layer photosensitive layer formation onto a conductive substrate and drying the applied application liquid for single-layer photosensitive layer formation. The application liquid for single-layer photosensitive layer formation is prepared by dissolving or dispersing a charge generating material, an electron transport material, and one or more optionally added components (for example, a hole transport material, a binder resin, and an additive) in a solvent.

No specific limitation is placed on the solvent included in the application liquid for single-layer photosensitive layer formation so long as respective components included in the application liquid can be dissolved or dispersed in the solvent. Examples of solvents include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, diethylene glycol dimethyl ether, and propylene glycol monomethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. One of the above-listed solvents is used independently or two or more of the above-listed solvents are used in combination. In order to improve workability in production of the photosensitive member, a non-halogenated solvent (solvent other than halogenated hydrocarbons) is preferably used.

The application liquid is prepared by mixing the components and dispersing the components in the solvent. Mixing or dispersion may be performed using for example a bead mill, a roll mill, a ball mill, an attritor, a paint shaker, or an ultrasonic disperser.

The application liquid for single-layer photosensitive layer formation may contain for example a surfactant in order to improve dispersibility of the components.

No specific limitation is placed on an application method of the application liquid for single-layer photosensitive layer formation so long as the application liquid can be uniformly applied over the conductive substrate. Examples of the application method include dip coating, spray coating, spin coating, and bar coating.

No specific limitation is placed on a drying method of the application liquid for single-layer photosensitive layer formation so long as the solvent included in the application liquid can be evaporated. Specific examples of the drying method include thermal treatment (hot-air drying) using a high temperature dryer or a reduced pressure dryer. Thermal treatment conditions are for example: a temperature of at least 40° C. and no higher than 150° C.; and a time of at least 3 minutes and no longer than 120 minutes.

Either or both of an intermediate layer formation process and a protective layer formation process may be included in the method for producing the photosensitive member, as necessary. Respective methods appropriately selected from known methods are adopted in the intermediate layer formation process and the protective layer formation process.

<2. Image Forming Apparatus>

Figure 3:
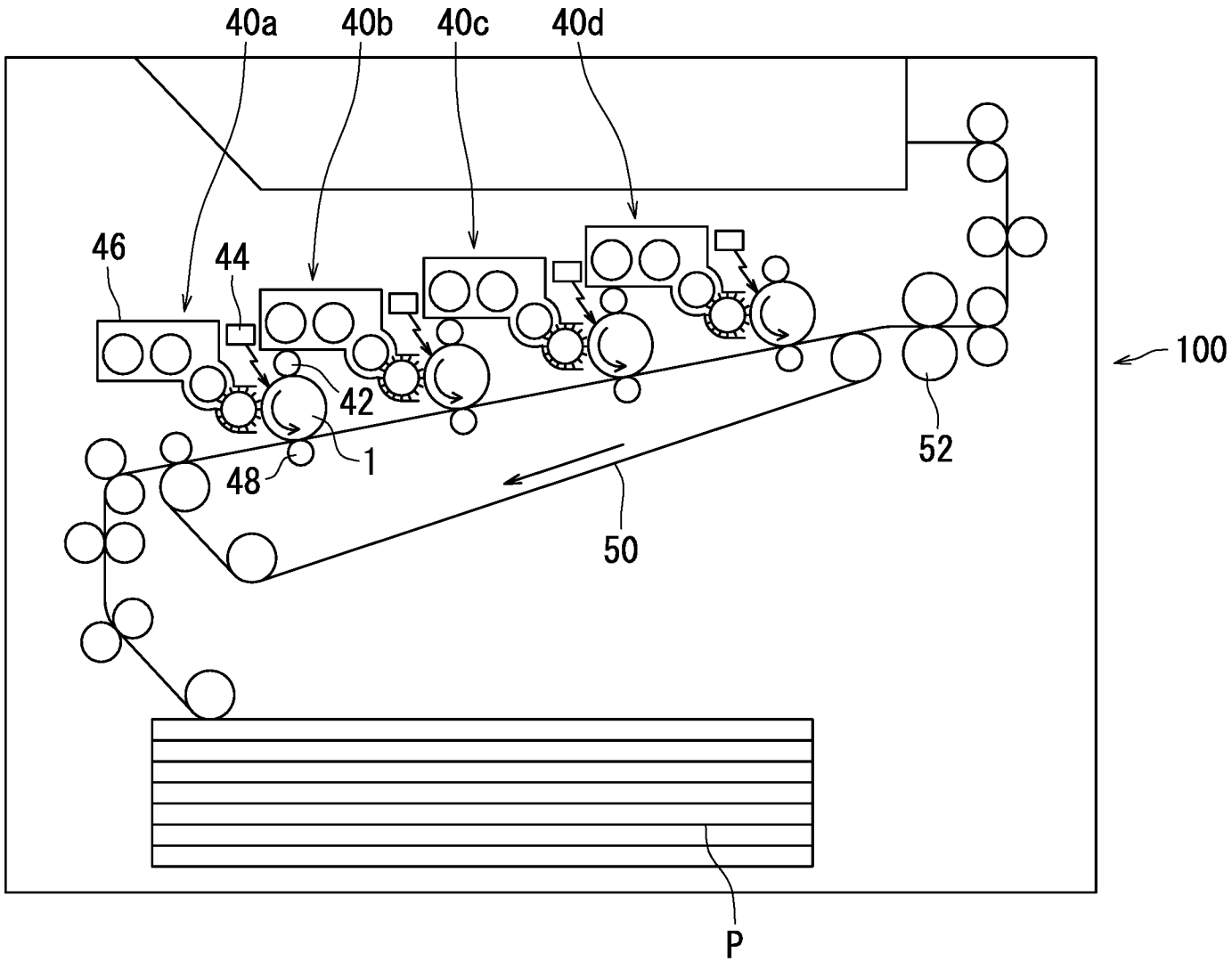
FIG. 3 is a diagram illustrating an example of a configuration of an image forming apparatus including the electrophotographic photosensitive member according to the embodiment of the present invention.

Next, an image forming apparatus 100 including the photosensitive member 1 according to the present embodiment will be described with reference to FIG. 3. FIG. 3 illustrates an example of a configuration of the image forming apparatus 100.

No specific limitation is placed on the image forming apparatus 100 so long as the image forming apparatus 100 is an electrophotographic image forming apparatus. The image forming apparatus 100 may for example be a monochrome image forming apparatus or a color image forming apparatus. In a case where the image forming apparatus 100 is a color image forming apparatus, the image forming apparatus 100 for example adopts a tandem system. The following describes as an example the image forming apparatus 100 adopting the tandem system.

The image forming apparatus 100 includes image formation units 40*a*, 40*b*, 40*c*, and 40*d*, a transfer belt 50, and a fixing device 52. In the following description, each of the image formation units 40*a*, 40*b*, 40*c*, and 40*d* will be referred to as an image formation unit 40 where there is no need to distinguish them from one another.

The image formation unit 40 includes the photosensitive member 1, a charger 42, a light exposure device 44, a developing device 46, and a transfer device 48. The photosensitive member 1 is located at the center of the image formation unit 40. The photosensitive member 1 is rotatable in an arrowed direction (i.e., counterclockwise). The charger 42, the light exposure device 44, the developing device 46, and the transfer device 48 are arranged around the photosensitive member 1 in the stated order from the upstream in the rotation direction of the photosensitive member 1 with the charger 42 as a reference. Note that the image formation unit 40 may further include either or both of a cleaner (not illustrated) and a static eliminator (not illustrated).

The charger 42 charges a surface of the photosensitive member 1. The charger 42 adopts a non-contact charging process or a contact charging process. Examples of chargers 42 adopting the non-contact charging process include a corotron charger and a scorotron charger. Examples of chargers 42 adopting the contact charging process include a charging roller and a charging brush.

The image forming apparatus 100 can include a charging roller as the charger 42. In charging the surface of the photosensitive member 1, the charging roller is in contact with the photosensitive member 1. In a situation in which minute components (for example, paper dust) of a recording medium P (for example, paper) are attached to the surface of the photosensitive member 1, the minute components are pressed against the surface of the photosensitive member 1 by the charging roller in contact with the photosensitive member 1. Through the above, the minute components tend to adhere to the surface of the photosensitive member 1. However, the photosensitive member 1 included in the image forming apparatus 100 can inhibit generation of white spots that would be otherwise caused by attachment of the minute components. Therefore, even in a configuration in which the image forming apparatus 100 includes the charging roller as the charger 42, the minute components hardly adhere to the surface of the photosensitive member 1 and generation of white spots in an image being formed can be inhibited.

Preferably, the charger 42 positively charges the surface of the photosensitive member 1. Upon contact between the photosensitive member 1 according to the present embodiment and the recording medium P, the recording medium P tends to be positively charged through friction with the photosensitive member 1. When the surface of the photosensitive member 1 is positively charged by the charger 42, the surface of the photosensitive member 1 and the recording medium P positively charged through triboelectric charging electrically repel each other. As a result, minute components of the recording medium P (for example, paper dust) hardly adhere to the surface of the photosensitive member 1 and generation of white spots in an image being formed can be favorably inhibited.

The light exposure device 44 irradiates the charged surface of the photosensitive member 1 with light. Through the above, an electrostatic latent image is formed on the surface of the photosensitive member 1. The electrostatic latent image is formed on the basis of image data input to the image forming apparatus 100.

The developing device 46 supplies toner to the electrostatic latent image formed on the photosensitive member 1. As a result, the electrostatic latent image is developed into a toner image. The photosensitive member 1 is equivalent to an image bearing member that bears the toner image thereon. The toner may be used as a one-component developer. Alternatively, the toner may be mixed with a desired carrier to use the toner in a two-component developer. In a situation in which the toner is used as the one-component developer, the developing device 46 supplies the toner, which is the one-component developer, to the electrostatic latent image formed on the photosensitive member 1. In a situation in which the toner is used in the two-component developer, the developing device 46 supplies to the electrostatic latent image formed on the photosensitive member 1 the toner of the two-component developer including the toner and the carrier.

The developing device 46 is capable of developing the electrostatic latent image into the toner image while in contact with the photosensitive member 1. That is, the image forming apparatus 100 can adopt a so-called contact development process. In a situation in which the minute components (for example, paper dust) of the recording medium P are attached to the surface of the photosensitive member 1, the minute components are pressed against the surface of the photosensitive member 1 by the developing device 46 in contact with the photosensitive member 1. Through the above, the minute components tend to adhere to the surface of the photosensitive member 1. However, the photosensitive member 1 included in the image forming apparatus 100 can inhibit generation of white spots that would be otherwise caused by attachment of the minute components. Therefore, even in a configuration in which the image forming apparatus 100 adopts the contact development process, the minute components hardly adhere to the surface of the photosensitive member 1 and generation of white spots in an image being formed can be inhibited.

The developing device 46 is capable of cleaning the surface of the photosensitive member 1. That is, the image forming apparatus 100 can adopt a so-called cleaner-less process. The developing device 46 is capable of removing components (hereinafter may be referred to as "residual components") remaining on the surface of the photosensitive member 1. Examples of residual components include toner components, and more specific examples are toner and detached external additive. Still other examples of residual components include non-toner components, and more specific examples are minute components (for example, paper dust) of the recording medium P. In the image forming apparatus 100 adopting the cleaner-less process, residual components on the surface of the photosensitive member 1 are not thoroughly scrapped off by a cleaner (for example, a cleaning blade). Therefore, the residual components usually tend to remain on the surface of the photosensitive member 1 included in the image forming apparatus 100 adopting the cleaner-less process. However, the photosensitive member 1 of the present embodiment can inhibit generation of white spots that would be otherwise caused by attachment of the minute components. Therefore, even in the image forming apparatus 100 including such a photosensitive member 1 adopting the cleaner-less process, residual components, particularly minute components (for example, paper dust) of the recording medium P hardly remain on the surface of the photosensitive member 1. As a result, the image forming apparatus 100 can inhibit generation of white spots in an image being formed.

In order that the developing device 46 efficiently cleans the surface of the photosensitive member 1, it is preferable that the following conditions (a) and (b) are satisfied.

Condition (a): The contact development process is adopted and there is a difference in peripheral speed (rotational speed) between the photosensitive member 1 and the developing device 46.

Condition (b): The surface potential of the photosensitive member 1 and the electric potential of a development bias satisfy the following expressions (b-1) and (b-2).

0 (V)<electric potential (V) of development bias<surface potential (V) of non-irradiated region of photosensitive member 1 (b-1)

electric potential (V) of development bias>surface potential (V) of irradiated region of photosensitive member 1>0 (V) (b-2)

When the contact development process is adopted and there is a difference in peripheral speed between the photosensitive member 1 and the developing device 46 as described in condition (a), the surface of the photosensitive member 1 is in contact with the developing device 46 and components attached to the surface of the photosensitive member 1 are removed through friction with the developing device 46. The peripheral speed of the developing device 46 is preferably higher than that of the photosensitive member 1.

In the condition (b), it is assumed that a reversal development process is adopted as the development process. In order to improve sensitivity characteristics of the photosensitive member 1, which is a single-layer photosensitive member, it is preferable that the charging polarity of toner, the surface potential of a non-irradiated region of the photosensitive member 1, the surface potential of an irradiated region of the photosensitive member 1, and the electric potential of the development bias are all positive. Note that the respective surface potentials of the non-irradiated region and the irradiated region of the photosensitive member 1 are measured after the toner image is transferred from the photosensitive member 1 to the recording medium P by the transfer device 48 and before the surface of the photosensitive member 1 is charged by the charger 42 in the next turn of the photosensitive member 1.

When the expression (b-1) of the condition (b) is satisfied, electrostatic repelling force acting between toner remaining on the photosensitive member 1 (hereinafter referred to as residual toner) and the non-irradiated region of the photosensitive member 1 is stronger than electrostatic repelling force acting between the residual toner and the developing device 46. Therefore, residual toner remaining on the non-irradiated region of the photosensitive member 1 moves from the surface of the photosensitive member 1 to the developing device 46 to be collected.

When the expression (b-2) of the condition (b) is satisfied, electrostatic repelling force acting between the residual toner and the irradiated region of the photosensitive member 1 is weaker than the electrostatic repelling force acting between the residual toner and the developing device 46. Therefore, residual toner remaining on the irradiated region of the photosensitive member 1 is held on the surface of the photosensitive member 1. The toner held on the irradiated region of the photosensitive member 1 is directly used for image formation.

The transfer belt 50 conveys the recording medium P to a site between the photosensitive member 1 and the transfer device 48. The transfer belt 50 is an endless belt. The transfer belt 50 is capable of circulating in an arrowed direction (i.e., clockwise).

The transfer device 48 transfers the toner image developed by the developing device 46 from the photosensitive member 1 to the recording medium P. In transfer of the toner image from the photosensitive member 1 to the recording medium P, the photosensitive member 1 is in contact with the recording medium P. That is, the image forming apparatus 100 adopts a so-called direct transfer process. An example of the transfer device 48 is a transfer roller.

Toner images in respective colors (for example, four colors of black, cyan, magenta, and yellow) are superimposed on one another in order on the recording medium P placed on the transfer belt 50 by the image formation units 40*a* to 40*d*. Note that in a case where the image forming apparatus 100 is a monochrome image forming apparatus, the image forming apparatus 100 includes the image formation unit 40*a* and the image formation units 40*b* to 40*d* are omitted.

The fixing device 52 applies heat and/or pressure to the unfixed toner image transferred to the recording medium P by the transfer device 48. The fixing device 52 includes for example a heating roller and/or a pressure roller. Through application of heat and/or pressure to the toner image, the toner image is fixed to the recording medium P. As a result, an image is formed on the recording medium P.

<3. Process Cartridge>

The following describes a process cartridge including the photosensitive member 1 of the present embodiment, continuously referring to FIG. 3. The process cartridge corresponds to each of the image formation units 40*a* to 40*d*. The process cartridge includes the photosensitive member 1. The process cartridge may further include at least one device selected from the group consisting of the charger 42, the light exposure device 44, the developing device 46, and the transfer device 48, in addition to the photosensitive member 1. The process cartridge may further include either or both of a cleaner (not illustrated) and a static eliminator (not illustrated). The process cartridge is attachable to and detachable from the image forming apparatus 100. Therefore, the process cartridge including the photosensitive member 1 is easy to handle and can be easily and quickly replaced when sensitivity characteristics or the like of the photosensitive member 1 degrades.

EXAMPLES

The following more specifically describes the present invention using examples. However, the present invention is by no means limited to the scope of the examples.

<1. Materials for Single-Layer Photosensitive Layer Formation>

The following charge generating material, hole transport material, electron transport materials, and binder resins were prepared as materials for forming single-layer photosensitive layers of photosensitive members.

<1-1. Charge Generating Material>

An X-form metal-free phthalocyanine was prepared as the charge generating material. The X-form metal-free phthalocyanine was a metal-free phthalocyanine represented by chemical formula (CGM-1) shown above in the embodiment. The X-form metal-free phthalocyanine had X-form crystal structure.

<1-2. Hole Transport Material>

The compound (2-1) described above in the embodiment was prepared as the hole transport material.

<1-3. Binder Resin>

Resins (3-1a) and (3-2a) were prepared as the binder resins.

The resin (3-1a) was a polycarbonate resin represented by chemical formula (3-1) shown above in the embodiment. The resin (3-1a) had a viscosity average molecular weight of 30,000.

The resin (3-2a) was a polycarbonate resin represented by chemical formula (3-2) shown above in the embodiment. The resin (3-2a) had a viscosity average molecular weight of 30,000.

<1-4. Electron Transport Material>

The compounds (1-1) to (1-5) described above in the embodiment were prepared as the electron transport materials. The compounds (1-1) to (1-5) were each produced through the reactions (r-a) to (r-d) described above in the embodiment. Specifically, the compounds (1-1) to (1-5) were produced as described below.

(Reaction (r-a))

A compound (F-1) shown below was used as the compound (F) in the reaction (r-a). A compound (A-1), (A-2), or (A-3) shown below was used as the compound (A) in the reaction (r-a). A compound (B-1), (B-2), or (B-3) shown below was obtained as the compound (B'), which was a reaction product of the reaction (r-a).

(F-1)

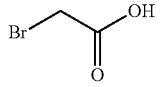

-continued (A-1)

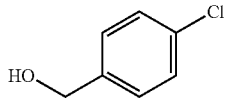

(A-2)

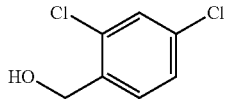

(A-3)

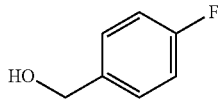

(B-1)

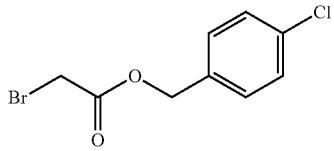

(B-2)

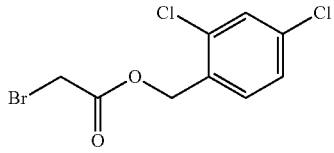

(B-3)

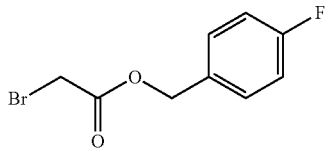

Specifically, the compound (B-1) was produced as described below. A reaction (r-a1) shown below was caused as the reaction (r-a) to obtain the compound (B-1).

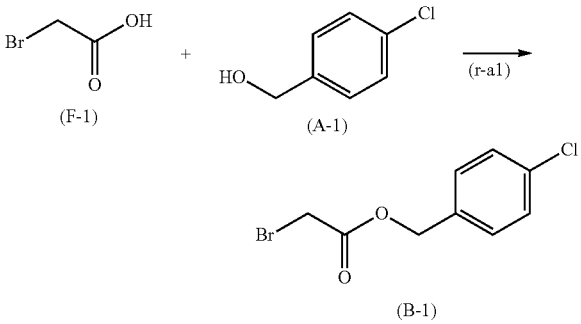

In the reaction (r-a1), the compound (F-1) and the compound (A-1) were reacted to obtain the compound (B-1). Specifically, the compound (F-1) (bromoacetic acid, 1.39 g, 10 mmol) and the compound (A-1) (1.43 g, 10 mmol) were dissolved in chloroform (50 mL) to obtain a chloroform solution. N,N'-dicyclohexylcarbodiimide (4.12 g, 20 mmol) was added to the chloroform solution. The resultant mixture was stirred for 8 hours at room temperature (25° C.). After the 8-hour stirring, the mixture was filtered to obtain a filtrate. Chloroform was evaporated from the filtrate under depressurization to obtain a residue. The residue was purified by silica gel column chromatography using chloroform as a developing solvent. As a result, the compound (B-1) was obtained. A mass yield of the compound (B-1) was 2.11 g. A percentage yield of the compound (B-1) from the compound (F-1) was 80 mol %.

The compound (B-2) was obtained by causing the reaction (r-a1) by the same method as that for production of the compound (B-1) in all aspects other than the following change. The compound (A-2) (1.77 g, 10 mmol) was used as the compound (A) instead of the compound (A-1) (1.43 g, 10 mmol) used in production of the compound (B-1). As a result, the compound (B-2) was obtained as the compound (B') instead of the compound (B-1). A mass yield of the compound (B-2) was 2.24 g. A percentage yield of the compound (B-2) from the compound (F-1) was 75 mol %.

The compound (B-3) was obtained by causing the reaction (r-a1) by the same method as that for production of the compound (B-1) in all aspects other than the following change. The compound (A-3) (1.26 g, 10 mmol) was used as the compound (A) instead of the compound (A-1) (1.43 g, 10 mmol) used in production of the compound (B-1). As a result, the compound (B-3) was obtained as the compound (B') instead of the compound (B-1). A mass yield of the compound (B-3) was 1.98 g. A percentage yield of the compound (B-3) from the compound (F-1) was 80 mol %.

(Reaction (r-b))

A compound (G-1) shown below was used as the compound (G) in the reaction (r-b). Any of the compounds (B-1) to (B-5) was used as the compound (B) in the reaction (r-b). The compounds (B-1) to (B-3) obtained through the above reaction (r-a) were used as the compounds (B-1) to (B-3), respectively. Commercially available products were used as the compounds (B-4) and (B-5) shown below. Any of compounds (C-1) to (C-5) shown below was obtained as the compound (C), which was a reaction product of the reaction (r-b).

(G-1)

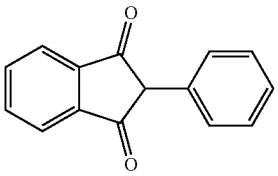

(B-1)

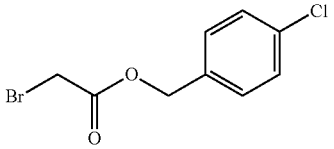

(B-2)

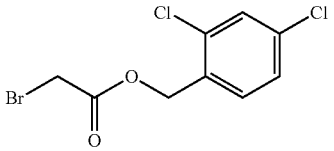

(B-3)

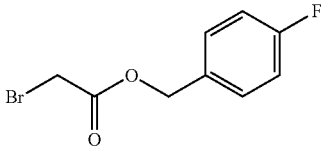

-continued (B-4)

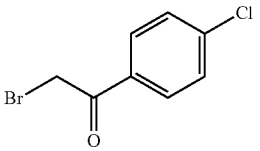

(B-5)

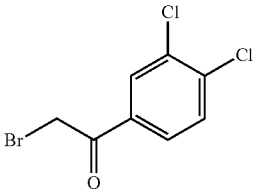

(C-1)

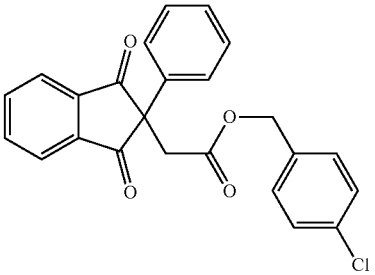

(C-2)

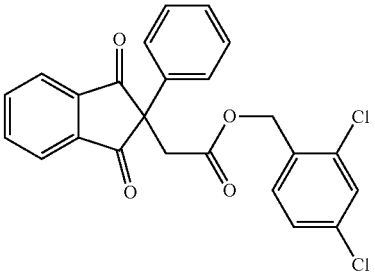

(C-3)

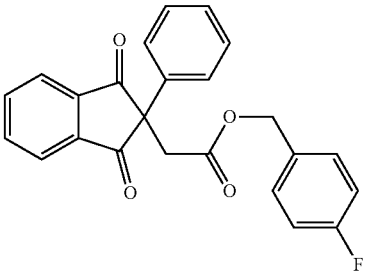

(C-4)

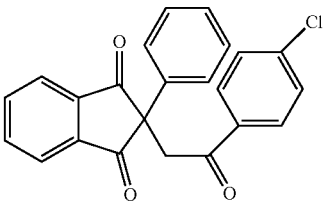

-continued (C-5)

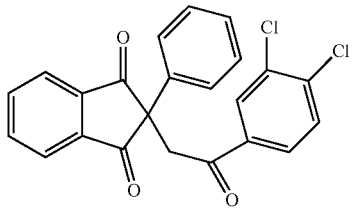

Specifically, the compound (C-1) was produced as described below. A reaction (r-b1) shown below was caused as the reaction (r-b) to obtain the compound (C-1).

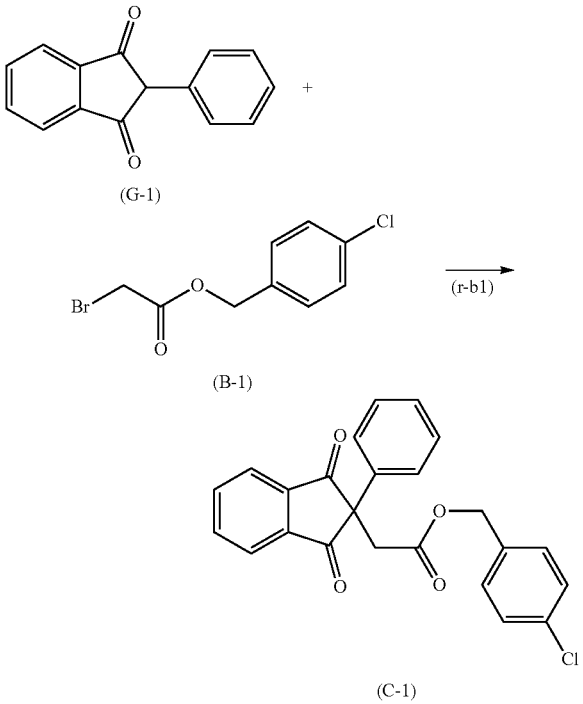

In the reaction (r-b1), the compound (G-1) and the compound (B-1) were reacted to obtain the compound (C-1). Specifically, the compound (G-1) (phenylindanedione, 2.22 g, 10 mmol) and 40% sodium hydride (NaH, 0.72 g, 12 mmol) were placed in a vessel within which the air had been replaced with argon gas. The vessel was cooled using ice, and distilled tetrahydrofuran (100 mL) was added into the vessel. Further, a distilled tetrahydrofuran solution (50 mL) of the compound (B-1) (2.63 g, 10 mmol) was added into the vessel. The vessel contents were refluxed under stirring for 4 hours at 90° C. Subsequently, water was added into the vessel to cause precipitation of a solid. The precipitated solid was collected through filtration to obtain a residue. The residue was dissolved in chloroform to obtain a chloroform solution. Water was added to the chloroform solution to extract an organic layer. Chloroform, which is a solvent, was evaporated from the organic layer to obtain a residue. The residue was crystallized with chloroform/methanol (volume ratio: 1/1). As a result, the compound (C-1) was obtained. A mass yield of the compound (C-1) was 3.23 g. A percentage yield of the compound (C-1) from the compound (G-1) was 80 mol %.

The compounds (C-2) to (C-5) were each obtained by causing the reaction (r-b1) by the same method as that for production of the compound (C-1) in all aspects other than the following changes. Any of the compounds (B-2) to (B-5) shown in Table 1 was used as the compound (B) instead of the compound (B-1) used in production of the compound (C-1). The mass of the compound (B), which was 2.63 g in production of the compound (C-1), was changed to a corresponding mass shown in Table 1. Note that the number of moles of the compound (B), which was 10 mmol in production of the compound (C-1), was not changed. As a result, a corresponding one of the compounds (C-2) to (C-5) was obtained as the compound (C) instead of the compound (C-1). Respective mass yields of the obtained compounds (C-2) to (C-5) are shown in Table 1. Respective percentage yields of the compounds (C-2) to (C-5) from the compound (G-1) are shown in Table 1.

TABLE 1

| | Reaction (r-b) | | | | | | | | |
|---|---|---|---|---|---|---|---|---|---|
| | | | | | | | Compound (C) | | |
| | Compound (G) | | | Compound (B) | | | | | |
| Final target compound | Type | Mass (g) | Number of moles (mmol) | Type | Mass (g) | Number of moles (mmol) | Type | Mass yield (g) | Percentage yield (mol %) |
| 1-1 | G-1 | 2.22 | 10 | B-1 | 2.63 | 10 | C-1 | 3.23 | 80 |
| 1-2 | G-1 | 2.22 | 10 | B-2 | 2.98 | 10 | C-2 | 3.29 | 75 |
| 1-3 | G-1 | 2.22 | 10 | B-3 | 2.47 | 10 | C-3 | 2.91 | 75 |
| 1-4 | G-1 | 2.22 | 10 | B-4 | 2.34 | 10 | C-4 | 2.99 | 80 |
| 1-5 | G-1 | 2.22 | 10 | B-5 | 2.68 | 10 | C-5 | 3.27 | 80 |

(Reaction (r-c) and Reaction (r-d))

In the reaction (r-c), any of the compounds (C-1) to (C-5) was used as the compound (C). A corresponding one of compounds (D-1) to (D-5) shown below was obtained as the compound (D), which was a reaction product of the reaction (r-c). In the reaction (r-d), any of the compounds (D-1) to (D-5) obtained through the reaction (r-c) was used as the compound (D). A corresponding one of the compounds (1-1) to (1-5) was obtained as the compound (1), which was a reaction product of the reaction (r-d).

(D-1)

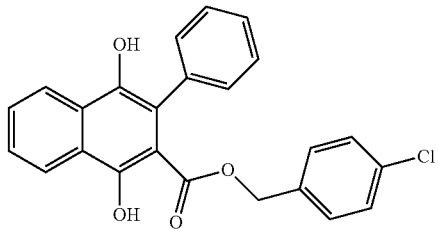

(D-2)

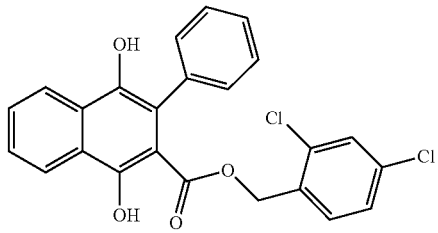

-continued (D-3)

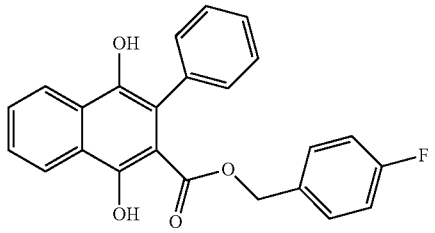

(D-4)

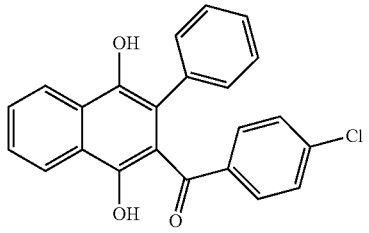

(D-5)

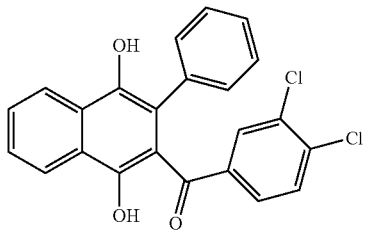

Specifically, the compound (D-1) was produced as described below. A reaction (r-c1) shown below was caused as the reaction (r-c) to obtain the compound (D-1).

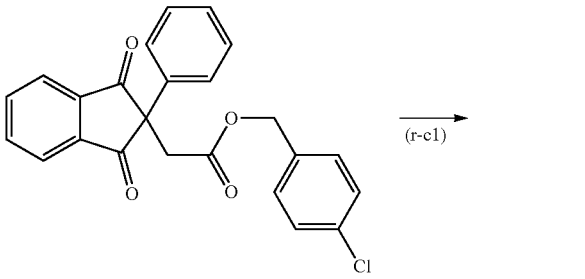

(C-1)

(D-1)

In the reaction (r-c1), the compound (C-1) (4.04 g, 10 mmol) and 40% sodium hydride (NaH, 0.72 g, 12 mmol) were placed in a vessel within which the air had been replaced with argon gas. The vessel was cooled using ice, and then distilled tetrahydrofuran (100 mL) was added into the vessel. The vessel contents were refluxed under stirring for 4 hours at 90° C. Subsequently, water was added into the vessel to cause precipitation of a solid. The precipitated solid was collected through filtration to obtain a residue. The residue was dissolved in chloroform to obtain a chloroform solution. Water was added to the chloroform solution to extract an organic layer. Chloroform, which is a solvent, was evaporated from the organic layer to obtain a residue. The residue was crystallized with chloroform/hexane (volume ratio: 1/1) to obtain a crude product of the compound (D-1). The crude product of the compound (D-1) was used directly for the reaction (r-d) without being purified.

Specifically, the compound (1-1) was produced as described below. A reaction (r-d1) shown below was caused as the reaction (r-d) to obtain the compound (1-1).

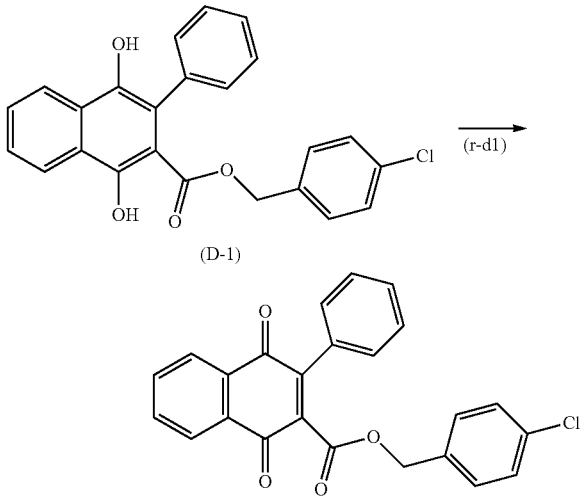

(D-1)

(1-1)

In the reaction (r-d1), the crude product of the compound (D-1) obtained through the reaction (r-c1) and chloranil (3.69 g, 15 mmol) were dissolved in 100 mL of chloroform to obtain a chloroform solution. The chloroform solution was stirred for 8 hours at room temperature (25° C.). After the 8-hour stirring, the resultant mixture was filtered to obtain a filtrate. Chloroform was evaporated from the filtrate under depressurization to obtain a residue. The residue was purified by silica gel column chromatography using chloroform as a developing solvent. As a result, the compound (1-1) was obtained. A mass yield of the compound (1-1) was 2.41 g. A percentage yield of the compound (1-1) yielded through the two-step reaction from the compound (C-1) was 60 mol %.

The compounds (D-2) to (D-5) were each obtained by causing the reaction (r-c1) by the same method as that for production of the compound (D-1) in all aspects other than the following changes. Any of the compounds (C-2) to (C-5) shown in Table 2 was used as the compound (C) instead of the compound (C-1) used in production of the compound (D-1). The mass of the compound (C), which was 4.04 g in production of the compound (D-1), was changed to a corresponding mass shown in Table 2. Note that the number of moles of the compound (C), which was 10 mmol in production of the compound (D-1), was not changed. As a result, a corresponding one of the compounds (D-2) to (D-5) was obtained as the compound (D) instead of the compound (D-1).

The compounds (1-2) to (1-5) were each obtained by causing the reaction (r-d1) by the same method as that for production of the compound (1-1) in all aspects other than the following changes. Any of the compounds (D-2) to (D-5) shown in Table 2 was used as the compound (D) instead of the compound (D-1) used in production of the compound (1-1). As a result, a corresponding one of the compounds (1-2) to (1-5) was obtained as the compound (1) instead of the compound (1-1).

TABLE 2

| | Reaction (r-c) | | | | Reaction (r-d) | | | |
|---|---|---|---|---|---|---|---|---|
| | Compound (C) | | | | | Compound (1) | | |
| Final target compound | Type | Mass (g) | Number of moles (mmol) | Compound (D) Type | Compound (D) Type | Type | Mass yield (g) | Percentage yield through two step reaction (mol %) |
| 1-1 | C-1 | 4.04 | 10 | D-1 | D-1 | 1-1 | 2.41 | 60 |
| 1-2 | C-2 | 4.39 | 10 | D-2 | D-2 | 1-2 | 2.84 | 65 |
| 1-3 | C-3 | 3.88 | 10 | D-3 | D-3 | 1-3 | 2.50 | 60 |
| 1-4 | C-4 | 3.75 | 10 | D-4 | D-4 | 1-4 | 2.23 | 60 |
| 1-5 | C-5 | 4.09 | 10 | D-5 | D-5 | 1-5 | 2.65 | 65 |

Next, $^1$H-NMR spectrums of the produced compounds (1-1) to (1-5) were measured using a proton nuclear magnetic resonance ($^1$H-NMR) spectrometer. The magnetic field intensity was set at 270 MHz. Deuterated chloroform ($CDCl_3$) was used as a solvent. Tetramethylsilane (TMS) was used as an internal standard substance.

Figure 4:
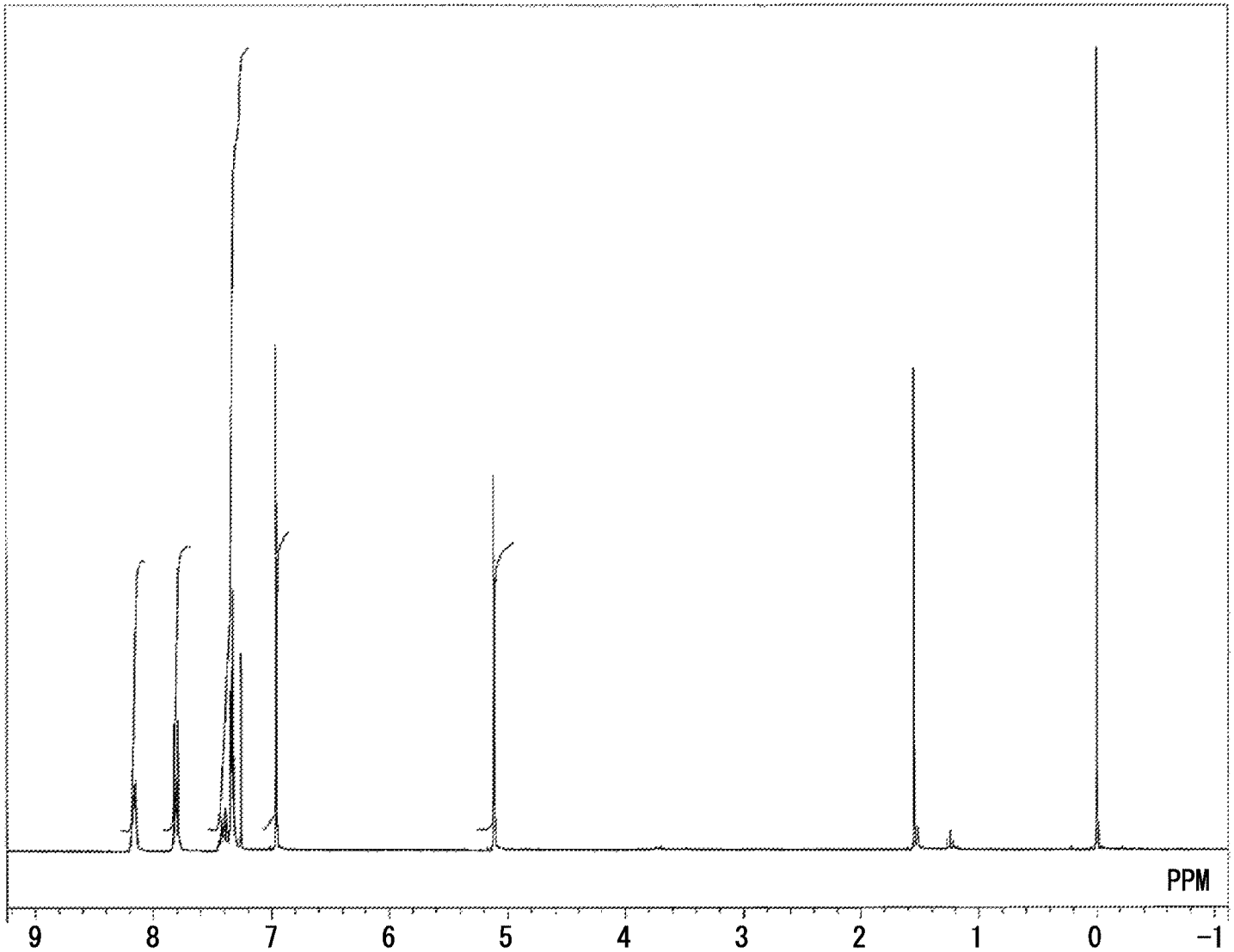
FIG. 4 is a $^{1}$H-NMR spectrum of a compound represented by chemical formula (1-1) contained in the electrophotographic photosensitive member according to the embodiment of the present invention.

FIG. 4 shows the $^1$H-NMR spectrum of the compound (1-1) as a representative example of the compounds (1-1) to (1-5). Chemical shift values of the $^1$H-NMR spectrum of the compound (1-1) are shown below. Based on the measured $^1$H-NMR spectrum and the chemical shift values, it was confirmed that the compound (1-1) was obtained. Similarly, it was confirmed that the compounds (1-2) to (1-5) were obtained based on the measured $^1$H-NMR spectrums and respective chemical shift values.

Compound (1-1): $^1$H-NMR (270 MHz, $CDCl_3$) δ=8.14-8.19 (m, 2H), 7.79-7.83 (m, 2H), 7.30-7.44 (m, 7H), 6.96 (s, 2H), 5.11 (s, 2H).

Compounds (E-1) and (E-2) were also prepared as the electron transport materials. The compounds (E-1) and (E-2) are represented by chemical formulas (E-1) and (E-2) shown below, respectively.

(E-1)

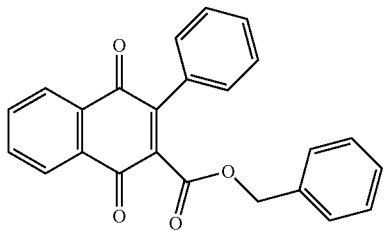

(E-2)

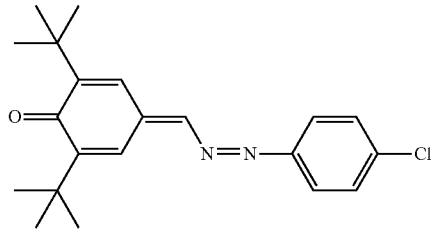

<2. Production of Photosensitive Members>

Photosensitive members (P-1) to (P-16) were produced with the materials for forming the single-layer photosensitive members.

<2-1. Production of Photosensitive Member (P-1)>

A vessel was charged with 2 parts by mass of the X-form metal-free phthalocyanine as the charge generating material, 50 parts by mass of the compound (2-1) as the hole transport material, 30 parts by mass of the compound (1-1) as the electron transport material, 100 parts by mass of the resin (3-1a) as the binder resin, and 600 parts by mass of tetrahydrofuran as a solvent. The vessel contents were mixed for 12 hours using a ball mill to disperse the materials in the solvent. Through the above, an application liquid for single-layer photosensitive layer formation was obtained. The application liquid for single-layer photosensitive layer formation was applied by dip coating onto a drum-shaped aluminum support (diameter: 30 mm, entire length: 238.5 mm) as a conductive substrate. The applied application liquid for single-layer photosensitive layer formation was dried with hot air at 120° C. for 80 minutes. Through the above, a single-layer photosensitive layer (film thickness: 30 μm) was formed on the conductive substrate. As a result, the photosensitive member (P-1) was obtained.

<2-2. Production of Photosensitive Members (P-2) to (P-16)>

Each of the photosensitive members (P-2) to (P-16) was produced by the same method as that for production of the photosensitive member (P-1) in all aspects other than the following changes. The compound (1-1) used as the electron transport material in production of the photosensitive member (P-1) was changed to an electron transport material of a type shown in Table 3. The amount (additive amount) of the electron transport material relative to 100 parts by mass of the binder resin, which was 30 parts by mass in production of the photosensitive member (P-1), was changed to an amount (additive amount) shown in Table 3. The resin (3-1a) used as the binder resin in production of the photosensitive member (P-1) was changed to a binder resin of a type shown in Table 3.

<3. Evaluation of Sensitivity Characteristics>

Sensitivity characteristics were evaluated with respect to each of the produced photosensitive members (P-1) to (P-16). The evaluation of the sensitivity characteristics was performed in an environment at a temperature of 23° C. and a relative humidity of 50%. First, a surface of the photosensitive member was charged to +600 V using a drum sensitivity test device (product of Gen-Tech, Inc.). Next, monochromatic light (wavelength: 780 nm, half-width: 20 nm, optical energy: 1.5 μJ/cm$^2$) was obtained from white light emitted from a halogen lamp using a bandpass filter. The surface of the photosensitive member was irradiated with the obtained monochromatic light. A surface potential of the photosensitive member was measured when 0.5 seconds elapsed from termination of the irradiation. The measured surface potential was taken to be a sensitivity potential ($V_L$, unit: +V, hereinafter referred to as a post-irradiation electric potential). The measured post-irradiation electric potential ($V_L$) is shown in Table 3. Note that a smaller positive value of the post-irradiation electric potential ($V_L$) indicates more excellent sensitivity characteristics of the photosensitive member.

<4. Measurement of Amount of Charge of Calcium Carbonate>

With respect to each of the produced photosensitive members (P-1) to (P-16), an amount of charge of calcium carbonate was measured.

The following describes a method for measuring an amount of charge of calcium carbonate by charging the calcium carbonate through friction with the photosensitive layer 3 (corresponding to the single-layer photosensitive layer 3*c*) with reference to FIG. 2 again. The amount of charge of calcium carbonate was measured by the first through fourth steps described below. A jig 10 was used for measurement of the amount of charge of calcium carbonate.

The jig 10 includes a first table 12, a rotary shaft 14, a rotary driving device 16 (for example, a motor), and a second table 18. The rotary driving device 16 rotates the rotary shaft 14. The rotary shaft 14 rotates about a rotation axis S thereof. The first table 12 rotates about the rotation axis S together with the rotary shaft 14. The second table 18 is fixed so as not to rotate.

(First Step)

In the first step, two photosensitive layers 3 were prepared. In the following description, one of the two photosensitive layers 3 will be referred to as a first photosensitive layer 30 and the other of the two photosensitive layers 3 will be referred to as a second photosensitive layer 32. First, a first film 20 with the first photosensitive layer 30 formed thereon was prepared. The first photosensitive layer 30 had a film thickness L1 of 30 μm. Also, a second film 22 with the second photosensitive layer 32 formed thereon was prepared. The second photosensitive layer 32 had a film thickness L2 of 30 μm. Specifically, an overhead projector (OHP) film was used as each of the first film 20 and the second film 22. The first film 20 and the second film 22 each had a circular shape with a diameter of 3 cm. The application liquid for single-layer photosensitive layer formation used in production of the photosensitive member (P-1) was applied over the first film 20 and the second film 22. The applied application liquid for single-layer photosensitive layer formation was dried with hot air at 120° C. for 80 minutes. Through the above, the first film 20 with the first photosensitive layer 30 formed thereon and the second film 22 with the second photosensitive layer 32 formed thereon were obtained.

(Second Step)

In the second step, 0.007 g of calcium carbonate was applied over the first photosensitive layer 30. Through the above, a calcium carbonate layer 24 made from the calcium carbonate was formed on the first photosensitive layer 30. Then, the second photosensitive layer 32 was placed on the calcium carbonate layer 24. Specifically, the second step was performed as described below.

First, the first film 20 was secured to the first table 12 using double sided tape. Then, 0.007 g of calcium carbonate was applied over the first photosensitive layer 30 on the first film 20. Through the above, the calcium carbonate layer 24 made from the calcium carbonate was formed on the first photosensitive layer 30. The second film 22 was secured to the second table 18 using double sided tape such that the calcium carbonate layer 24 came into contact with the second photosensitive layer 32. As a result, the first table 12, the first film 20, the first photosensitive layer 30, the calcium carbonate layer 24, the second photosensitive layer 32, the second film 22, and the second table 18 were layered in the stated order from the bottom. The first table 12, the first film 20, the first photosensitive layer 30, the second photosensitive layer 32, the second film 22, and the second table 18 were arranged such that respective centers thereof coincided with the rotation axis S.

(Third Step)

In the third step, the first photosensitive layer 30 was rotated at a rotational speed of 60 rpm for 60 seconds while the second photosensitive layer 32 was fixed in an environment at a temperature of 23° C. and a relative humidity of 50%. Specifically, the rotary shaft 14, the first table 12, the first film 20, and the first photosensitive layer 30 were rotated about the rotation axis S at the rotational speed of 60 rpm for 60 seconds by driving the rotary driving device 16. Through the above, the calcium carbonate contained in the calcium carbonate layer 24 was charged through friction with the first photosensitive layer 30 and the second photosensitive layer 32.

(Fourth Step)

In the fourth step, the calcium carbonate charged in the third step was collected from the jig 10 and sucked using a charge measuring device (compact draw-off charge measurement system "MODEL 212HS" manufactured by TREK, INC.). A total electric amount Q (unit: +μC) and a mass M (unit: g) of the sucked calcium carbonate were measured using the charge measuring device. An amount of charge (amount of triboelectric charge, unit: +μC/g) of the calcium carbonate was calculated based on an expression "amount of charge=Q/M".

An amount of charge of calcium carbonate was measured with respect to each of the photosensitive members (P-2) to (P-16) by the same method as that for measurement of the amount of charge of the calcium carbonate with respect to the photosensitive member (P-1) in all aspects other than the following change. In the first step, an application liquid for single-layer photosensitive layer formation used in production of a corresponding one of the photosensitive members (P-2) to (P-16) was used instead of the application liquid for single-layer photosensitive layer formation used in production of the photosensitive member (P-1).

Amounts of charge of the calcium carbonate calculated for the respective photosensitive members (P-1) to (P-16) are shown in Table 3. Note that a greater positive value indicating an amount of charge of calcium carbonate indicates a higher level of positive chargeability of the calcium carbonate with respect to the first photosensitive layer 30 and the second photosensitive layer 32.

<5. Evaluation of Image Characteristics>

Image characteristics were evaluated with respect to each of the produced photosensitive members (P-1) to (P-16). The evaluation of the image characteristics was performed in an environment at a temperature of 32.5° C. and a relative humidity of 80%. An image forming apparatus (modified version of "MONOCHROME PRINTER FS-1300D" manufactured by KYOCERA Document Solutions Inc.) was used as an evaluation apparatus. Specifically, the image forming apparatus adopting a non-contact development process was modified to that adopting the contact development process. Also, the image forming apparatus adopting a blade cleaning process was modified to that adopting the cleaner-less process. Also, a scorotron charger was replaced with a charging roller. The charging polarity of the charging roller was set to be positive. Note that the image forming apparatus adopted the direct transfer process. A recording medium used was "KYOCERA Document Solutions Inc. brand paper VM-A4" (A4 size) sold by KYOCERA Document Solutions Inc. A one-component developer (prototype) was used for evaluation performed using the evaluation apparatus.

An image I (image with a printing rate of 1%) was continuously printed on 20,000 sheets of the recording medium using the evaluation apparatus at a rotational speed of a photosensitive member of 168 mm/second. Subsequently, an image II (black solid image of A4 size) was printed on a sheet of the recording medium. The recording medium with the image II formed thereon was observed with unaided eyes to count the number of white spots in the image II. The number of white spots in the image II tends to increase with an increase of minute components of the recording medium (for example, paper dust) attached to the photosensitive member. The number of white spots observed in the image II is shown in Table 3.

In Table 3, ETM represents electron transport material, and $V_L$ represents post-irradiation electric potential. ETM Amount (additive amount) represents an amount (additive amount) of the electron transport material relative to 100 parts by mass of the binder resin.

TABLE 3

| | Photosensitive layer | | | | | Amount of | |
|---|---|---|---|---|---|---|---|
| | Photo-sensitive member | Binder resin | ETM Type | ETM Amount [parts by mass] | Sensitivity characteristics $V_L$ (+V) | charge of calcium carbonate (+μC/g) | Image characteristics Number of white spots |
| Example 1 | P-1 | 3-1a | 1-1 | 30 | 147 | 9.0 | 33 |
| Example 2 | P-2 | 3-2a | 1-1 | 30 | 145 | 9.0 | 35 |
| Example 3 | P-3 | 3-1a | 1-2 | 30 | 148 | 9.5 | 26 |
| Example 4 | P-4 | 3-2a | 1-2 | 30 | 144 | 9.3 | 27 |
| Example 5 | P-5 | 3-1a | 1-3 | 30 | 146 | 9.1 | 32 |
| Example 6 | P-6 | 3-2a | 1-3 | 30 | 142 | 9.0 | 33 |
| Example 7 | P-7 | 3-1a | 1-4 | 30 | 152 | 9.1 | 35 |
| Example 8 | P-8 | 3-2a | 1-4 | 30 | 148 | 9.4 | 36 |
| Example 9 | P-9 | 3-1a | 1-5 | 30 | 157 | 9.4 | 26 |
| Example 10 | P-10 | 3-2a | 1-5 | 30 | 159 | 9.3 | 28 |
| Example 11 | P-11 | 3-1a | 1-5 | 20 | 165 | 9.0 | 32 |
| Example 12 | P-12 | 3-1a | 1-5 | 40 | 151 | 9.9 | 20 |
| Comparative Example 1 | P-13 | 3-1a | E-1 | 30 | 150 | 5.5 | 92 |
| Comparative Example 2 | P-14 | 3-2a | E-1 | 30 | 151 | 5.2 | 98 |
| Comparative Example 3 | P-15 | 3-1a | E-2 | 30 | 129 | 6.2 | 55 |
| Comparative Example 4 | P-16 | 3-2a | E-2 | 30 | 131 | 6.2 | 57 |

The photosensitive layers of the photosensitive members (P-1) to (P-12) were each a single-layer photosensitive layer containing the charge generating material and the compound (1) as the electron transport material. Specifically, the single-layer photosensitive layer contained any of the compounds (1-1) to (1-5) encompassed by the compound represented by general formula (1). An amount of charge of calcium carbonate as measured by charging the calcium carbonate through friction with the photosensitive layer was at least +7.0 μC/g. Therefore, with respect to each of the above photosensitive members, the number of white spots observed in the formed image was small as shown in Table 3, which indicates that generation of white spots was inhibited. Also, with respect to each of the above photosensitive members, generation of white spots in the image being formed could be inhibited without impairment of the sensitivity characteristics of the photosensitive member.

By contrast, the photosensitive layers of the photosensitive members (P-13) to (P-16) did not contain the compound (1). The compound (E-1) is not encompassed by the compound represented by general formula (1). Specifically, the compound (E-1) is represented by a chemical formula corresponding to general formula (1) where m and n both represent 0, and the compound (E-1) does not include a halogen atom. Also, the compound (E-2) is not encompassed by the compound represented by general formula (1). Specifically, the compound (E-2) includes a halogen atom, but does not have a skeleton of the compound represented by general formula (1). Also, with respect to each of the photosensitive layers of the photosensitive members (P-13) to (P-16), the amount of charge of calcium carbonate was smaller than +7.0 μC/g. Therefore, with respect to each of the above photosensitive members, the number of white spots observed in the formed image was large as shown in Table 3, which indicates that generation of white spots in the image being formed could not be inhibited.

The above results showed that the photosensitive member according to the present invention inhibits generation of white spots in an image being formed. Also, the above results showed that the process cartridge and the image forming apparatus according to the present invention inhibit generation of white spots in an image being formed.

INDUSTRIAL APPLICABILITY

The photosensitive member according to the present invention can be used for an image forming apparatus. The process cartridge and the image forming apparatus according to the present invention can be used for image formation on a recording medium.

The invention claimed is:

1. An electrophotographic photosensitive member comprising a conductive substrate and a photosensitive layer, wherein the photosensitive layer is a photosensitive layer of a single-layer structure containing a charge generating material and an electron transport material, the electron transport material includes a compound represented by a general formula (1) shown below, an amount of charge of calcium carbonate as measured by charging the calcium carbonate through friction with the photosensitive layer is at least +7.0 μC/g, and in the measurement of the amount of the charge of the calcium carbonate, (i) two of the photosensitive layers are prepared, one of the two photosensitive layers being a first photosensitive layer, another of the two photosensitive layers being a second photosensitive layer, the first and second photosensitive layers each having a circular shape with a diameter of 3 cm, (ii) 0.007 g of the calcium carbonate is applied over the first photosensitive layer to obtain a calcium carbonate layer made from the calcium carbonate, and the second photosensitive layer is placed on the calcium carbonate layer, (iii) the first photosensitive layer is rotated at a rotational speed of 60 rpm for 60 seconds while the second photosensitive layer is fixed in an environment at a temperature of 23° C. and a relative humidity of 50% to charge the calcium carbonate contained in the calcium carbonate layer through friction between the calcium carbonate and each of the first photosensitive layer and the second photosensitive layer, and (iv) the charged calcium carbonate is sucked using a charge measuring device, and a total electric amount Q and a mass M of the sucked calcium carbonate are measured using the charge measuring device to calculate the amount of the charge of the calcium carbonate according to an expression Q/M, (1)

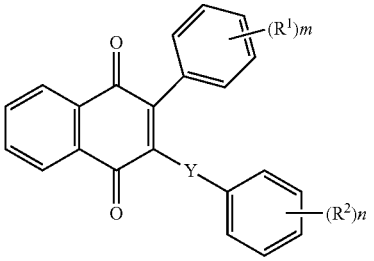

where in the general formula (1), $R^1$ and $R^2$ each represent, independently of each other:

a halogen atom;

an alkyl group having a carbon number of at least 1 and no greater than 8 and having at least one halogen atom;

an aryl group having a carbon number of at least 6 and no greater than 14, having at least one halogen atom, and optionally having an alkyl group having a carbon number of at least 1 and no greater than 6;

an aralkyl group having a carbon number of at least 7 and no greater than 20 and having at least one halogen atom; or a cycloalkyl group having a carbon number of at least 3 and no greater than 10 and having at least one halogen atom, m and n each represent, independently of each other, an integer of at least 0 and no greater than 5, with the proviso that at least one of the integers represented by m and n is not 0, and Y represents —CO—O—$CH_2$—, —CO—, or —CO—O—.

2. The electrophotographic photosensitive member according to claim 1, wherein in the general formula (1), m represents 0, and Y represents —CO—O—$CH_2$— or —CO—.

3. The electrophotographic photosensitive member according to claim 1, wherein in the general formula (1), $R^2$ represents a halogen atom, m represents 0, n represents 1 or 2, and Y represents —CO—O—$CH_2$— or —CO—.

4. The electrophotographic photosensitive member according to claim 1, wherein in the general formula (1), Y represents —CO—O—$CH_2$—.

5. The electrophotographic photosensitive member according to claim 1, wherein in the general formula (1), n represents 2.

6. The electrophotographic photosensitive member according to claim 1, wherein the compound represented by the general formula (1) is a compound represented by a chemical formula (1-1), (1-2), (1-3), (1-4), or (1-5) shown below (1-1)

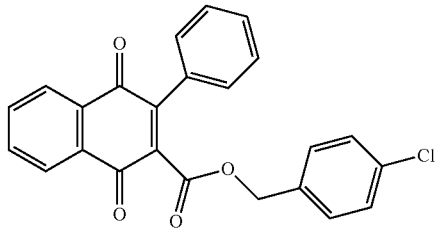

(1-2)

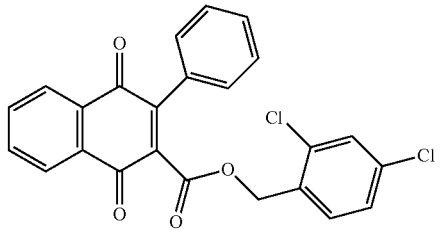

(1-3)

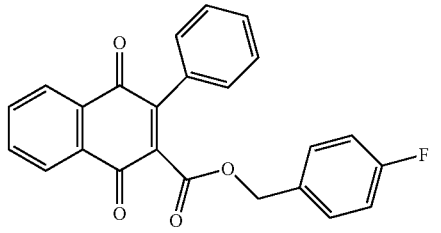

(1-4)

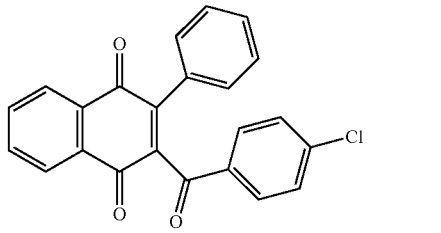

(1-5)

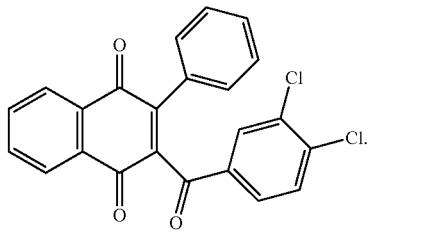

7. The electrophotographic photosensitive member according to claim 1, wherein the photosensitive layer further contains a hole transport material, and the hole transport material includes a compound represented by a general formula (2) shown below, (2)

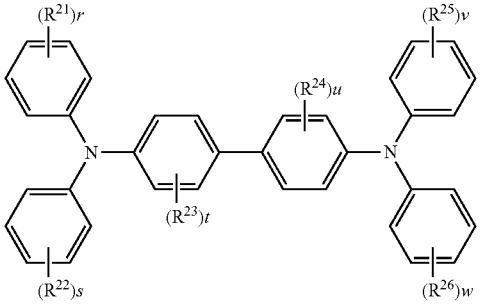

where in the general formula (2), $R^{21}$ to $R^{26}$ each represent, independently of each other, an alkyl group having a carbon number of at least 1 and no greater than 6 or an alkoxy group having a carbon number of at least 1 and no greater than 6, r, s, v, and w each represent, independently of one another, an integer of at least 0 and no greater than 5, and t and u each represent, independently of each other, an integer of at least 0 and no greater than 4.

8. The electrophotographic photosensitive member according to claim 1, wherein the photosensitive layer further contains a binder resin, and an amount of the compound represented by the general formula (1) is at least 20 parts by mass and no greater than 40 parts by mass relative to 100 parts by mass of the binder resin.

9. The electrophotographic photosensitive member according to claim 1, wherein the photosensitive layer further contains a binder resin, and the binder resin includes a resin represented by a general formula (3) shown below, (3)

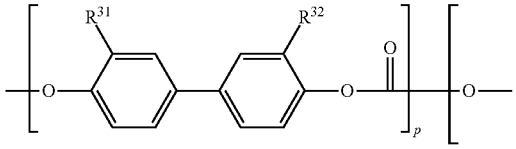

-continued

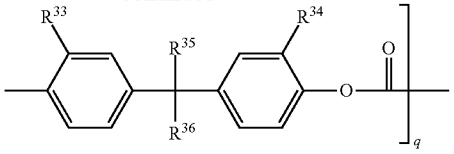

where in the general formula (3), $R^{31}$ to $R^{36}$ each represent, independently of one another, a hydrogen atom, an alkyl group having a carbon number of at least 1 and no greater than 6, or an aryl group having a carbon number of at least 6 and no greater than 14, $R^{35}$ and $R^{36}$ may be bonded to each other to represent a cycloalkylidene group having a carbon number of at least 5 and no greater than 7, $p+q=1.00$, and $0.00 \leq p \leq 0.90$.

10. A process cartridge comprising the electrophotographic photosensitive member according to claim 1.

11. An image forming apparatus comprising:

the electrophotographic photosensitive member according to claim 1; a charger; a light exposure device; a developing device; and a transfer device, wherein the charger charges a surface of the electrophotographic photosensitive member, the light exposure device irradiates the charged surface of the electrophotographic photosensitive member with light to form an electrostatic latent image on the surface of the electrophotographic photosensitive member, the developing device develops the electrostatic latent image into a toner image, the transfer device transfers the toner image from the electrophotographic photosensitive member to a recording medium, and in transfer of the toner image from the electrophotographic photosensitive member to the recording medium by the transfer device, the electrophotographic photosensitive member is in contact with the recording medium.

12. The image forming apparatus according to claim 11, wherein the developing device develops the electrostatic latent image into the toner image while in contact with the electrophotographic photosensitive member.

13. The image forming apparatus according to claim 11, wherein the developing device cleans the surface of the electrophotographic photosensitive member.

14. The image forming apparatus according to claim 11, wherein the charger is a charging roller.

15. The image forming apparatus according to claim 11, wherein the charger positively charges the surface of the electrophotographic photosensitive member.

* * * * *